US006310582B1

(12) United States Patent
Uetake et al.

(10) Patent No.: US 6,310,582 B1
(45) **Date of Patent: *Oct. 30, 2001**

(54) ANTENNA SYSTEM

(75) Inventors: Tatsuya Uetake, Tokyo; Masahiro Okamura, Chiba; Midori Taira, Kashiwa; Akito Kobayashi, Chiba; Ken Satou, Misato, all of (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/493,658

(22) Filed: Jan. 28, 2000

(30) Foreign Application Priority Data

| | | |
|---|---|---|
| Jan. 28, 1999 | (JP) | 11-019398 |
| Feb. 16, 1999 | (JP) | 11-036780 |
| Jul. 2, 1999 | (JP) | 11-188302 |
| Aug. 3, 1999 | (JP) | 11-220192 |

(51) Int. Cl.[7] ..... H01A 3/00

(52) U.S. Cl. ..... 343/765; 343/882; 343/890

(58) Field of Search ..... 343/765, 766, 343/878, 880, 882, 757, 890, 891, 758, 869, 839; 342/359

(56) References Cited

U.S. PATENT DOCUMENTS

| | | | | |
|---|---|---|---|---|
| 5,245,348 | * | 9/1993 | Nishikawa et al. | 342/359 |
| 5,422,648 | | 6/1995 | Uematsu et al. . | |
| 5,751,247 | * | 5/1998 | Nomoto et al. | 342/359 |
| 6,034,634 | * | 3/2000 | Karisson et al. | 342/359 |
| 6,043,788 | * | 3/2000 | Seavey | 343/781 CA |

FOREIGN PATENT DOCUMENTS

| | | |
|---|---|---|
| 63-018704 | 1/1988 | (JP) . |
| 63-056003 A | 3/1988 | (JP) . |
| 1132110 | 9/1989 | (JP) . |
| 9321523 | 12/1997 | (JP) . |
| 10-178313 A | 6/1998 | (JP) . |

* cited by examiner

*Primary Examiner*—Don Wong
*Assistant Examiner*—Ephrem Alemu

(57) ABSTRACT

When communication is performed simultaneously with two moving bodies such as a satellite, an antenna construction in which a plurality of antennas do not become an obstacle to each other's communication and the direction (the azimuth angle and the elevation angle) adjusting mechanism thereof can be realized with a simple construction. The two antennas have another movable portion (a rotation mechanism with respect to the axis) independently, while sharing the direction adjusting mechanism for the azimuth angle and the elevation angle. The rotation axis of the rotation mechanism of each antenna faces the same direction on the same plane, and each rotation mechanism is separately arranged in an area defined by a plane obtained by extending the axis of the azimuth angle adjusting mechanism toward the axial direction of the elevation angle adjusting mechanism. The azimuth angle and the elevation angle of respective antennas can be separately adjusted by the rotation mechanism with respect to the axis, hence the antennas can be directed to the communication targets existing in the two different directions simultaneously from the reception point.

17 Claims, 24 Drawing Sheets

ANTENNA SYSTEM

BACKGROUND OF THE INVENTION

1. Field of the Invention

The present invention relates to an antenna system suitable for a communication system using a non-geostationary satellite such as a low orbit satellite or the like.

2. Description of the Prior Art

FIG. 1 and FIG. 2 show the antenna system used for the communication with a conventional non-geostationary satellite. Conventionally, with this kind of antenna system, as shown in FIG. 1, a parabolic antenna 1 is attached to a support 103 having at both ends an elevation angle adjusting mechanism 101 adjustable in the angle Y (angle of elevation) from the horizontal direction and an azimuth angle adjusting mechanism 102 adjustable in the angle X (azimuth angle) in the horizontal direction, via the elevation angle adjusting mechanism 101.

Therefore, with the conventional antenna system, the elevation angle adjusting mechanism 101 and the azimuth angle adjusting mechanism 102 of the antenna are provided for each antenna, and the direction of the antenna is adjusted by adjusting the two adjusting mechanisms 101 and 102.

Therefore, at the time of communication with the non-geostationary satellite, when the direction of the communication target as seen from a reception point (where the antenna is set up) changes with the lapse of time, it is necessary to have the same number of antenna systems as shown in FIG. 1 as that of the communication targets, in order to communicate simultaneously with a plurality of communication targets which are in the different direction as seen from the reception point.

However, setting of a plurality of antennas including the direction adjusting mechanism has such problems that not only it simply takes up a lot of space, but also there is a case where antennas become an obstacle to the communication with each other, depending upon the positional relationship of the antennas and the direction of the communication target.

Therefore, there has been proposed an antenna system 1A having a construction shown in FIG. 2 in which two antenna systems are placed on the same turntable 105, and the turntable 105 is rotated so that the antennas 1*a* and 1*b* do not become an obstacle to the communication with each other.

However, with the construction of the antenna system 1A as shown in FIG. 2, five movable adjusting sections are required for adjusting the direction of the antennas 1*a* and 1*b*. Hence, there is a problem that the mechanism becomes complicated and the direction control of the antenna (particularly, the control of the azimuth angle X) becomes complicated.

Moreover, with the satellite communication using a non-geostationary satellite, since the position of the target satellite to be communicated with as seen from the reception point on the ground changes with the lapse of time, it is necessary to follow the target satellite and direct the antenna accurately to the satellite for continuing the communication (for example, see Japanese Patent Application Laid-open Hei 9 No. 321523).

When the satellite used for the communication is to be replaced, an operation for searching and acquiring a new satellite is necessary. Even if the orbit information of the satellite is known and estimate of the position of the satellite is possible by means of calculation, there is a subtle difference between the calculated value and the actual value, hence follow up and acquisition of a satellite cannot be done so easily by means of an antenna having a high directivity used in a ground station of the satellite communication.

Therefore, an auxiliary antenna for acquiring and following a satellite having a Low directivity compared to an antenna for communication (hereinafter referred to as a "pilot antenna") is provided in addition to the antenna for communication, and the actual position of the satellite is acquired by using the pilot antenna in advance, at the time of adjusting the direction of the antenna for communication.

However, even if the pilot antenna is used, the direction control mechanism of each antenna is independent and the set up position of the two antennas are different. Hence, when it is tried to direct the antenna for communication to the same direction as that of the pilot antenna which has acquired a satellite, directional control of the antenna becomes complicated.

SUMMARY OF THE INVENTION

In view of the above described problems in the prior art, the object of the present invention is to provide an antenna system which realizes a construction of antennas in which a plurality of antennas do not become an obstacle to each other at the time of communication, when the communication is set up simultaneously with two mobile bodies such as a satellite, and which realizes the direction (azimuth angle X and elevation angle Y) adjusting mechanism thereof with a simple construction.

Another object of the present invention is to provide an antenna system which can direct the communication antenna to the same direction as that of the pilot antenna which has acquired the target satellite very easily and rapidly, and the directional control can be performed easily so that antennas do not become an obstacle to the communication with each other.

With a view to attaining the above objects, the gist of the present invention is as follows.

The first gist of the present invention is an antenna system comprising: a first rotation mechanism supporting a first antenna rotatably in a first rotation direction centering around a first axis; a second rotation mechanism for supporting a second antenna rotatably in the first rotation direction centering around a second axis running along or in parallel to the first axis; an elevation angle adjusting mechanism for rotatably supporting the first and second rotation mechanisms commonly in a second rotation direction, centering around a third axis different from the first axis and the second axis; and an azimuth angle adjusting mechanism for rotatably supporting the elevation angle adjusting mechanism in a third rotation direction, centering around a fourth axis different from the first axis and the third axis; wherein the first rotation mechanism is provided in a first area partitioned by a plane containing the third axis and running in parallel to the fourth axis, and the second rotation mechanism is provided in a second area opposite to the first area.

The second gist of the present invention is an antenna system according to the first gist, characterized in that the first and second axes are provided symmetrically to a plane containing the fourth axis and running in parallel to the third axis.

The third gist of the present invention is an antenna system according to the first gist, characterized in that the third and fourth axes intersect each other, and the first and second axes are provided point-symmetrically with respect to an intersection of the third axis and the fourth axis.

The fourth gist of the present invention is an antenna system according to the first gist, characterized in that the third and fourth axes are orthogonal to each other, and the first and second axes are orthogonal to a plane determined by the third and fourth axes.

The fifth gist of the present invention is an antenna system according to the first gist, characterized in that the first and second axes penetrate the center of gravity of the respective antenna.

The sixth gist of the present invention is an antenna system according to the first gist, characterized in that the first antenna is constituted of a planar antenna, and the first axis penetrate the planar antenna bilaterally symmetrically.

The seventh gist of the present invention is an antenna system according to the first gist, characterized in that a third rotation mechanism is provided for supporting rotatably one or more antennas in the first rotation direction centering on the first axis.

The eighth gist of the present invention is an antenna system according to the first gist, characterized in that the first antenna comprises a spherical radio lens and a primary radiator for transmitting and receiving the radio wave, wherein the primary radiator rotates with the rotation of the first rotation mechanism along the peripheral direction around the periphery of the radio lens, to thereby realize the rotation of the antenna.

The ninth gist of the present invention is an antenna system according to the first gist, characterized in that a third antenna is provided which shares the first rotation mechanism with the first antenna, and points to a direction different from that of the first antenna.

The tenth gist of the present invention is an antenna system according to the ninth gist, characterized in that the first antenna and the third antenna are a planar antenna, respectively, and the first antenna and the third antenna are integrated back to back, and the both faces are used as the antenna.

The eleventh gist of the present invention is an antenna system according to the first gist, characterized in that the first antenna is a polyhedral antenna in a form of a square column, whose sides of N (natural number of $N \geqq 3$) are planar antennas.

The twelfth gist of the present invention is an antenna system according to the tenth gist, characterized in that the properties of the first antenna and the properties of the third antenna are different.

The thirteenth gist of the present invention is an antenna system according to the eleventh gist, characterized in that the N planar antennas comprise more than two kinds of planar antennas having different properties.

The fourteenth gist of the present invention is an antenna system according to the first gist, characterized in that the first antenna is for communication, and the second antenna is a pilot antenna.

The fifteenth gist of the present invention is an antenna system according to the seventh gist, characterized in that among three antennas, two of them are antennas for communicating with a satellite and the remaining one is a pilot antenna.

The sixteenth gist of the present invention is an antenna system according to the seventh gist, characterized in that among three antennas, two of them are pilot antennas and the remaining one is an antenna for communicating with a satellite.

The seventeenth gist of the present invention is an antenna system according to the sixteenth gist, characterized in that the method of rotating the two pilot antennas is changed for each antenna.

The antenna system of the present invention has a construction that two antennas share an adjusting mechanism for the azimuth angle and the elevation angle, while each antenna has another movable portion (rotation mechanism) independently. Therefore, since each antenna is separately adjustable by means of each rotation mechanism, while sharing the adjusting mechanism for the azimuth angle and the elevation angle, it becomes possible to direct the antennas to communication targets which are in the two different directions from the reception point at the same time. That is to say, there is a freedom for three directions: the azimuth angle, the elevation angle and the rotation direction of the antenna.

According to the construction of the first gist, since a part of the direction adjusting mechanism of the antenna is shared, the dimension can be made smaller than the case where a plurality of conventional antenna systems are used.

Moreover, not only communication with two different communication targets can be performed using a plurality of antennas, but also a plurality of antennas can be used for one communication target at the same time, hence adjustment of the gain and the directivity of the antenna becomes possible.

Furthermore, with the construction of the conventional antenna system (construction in FIG. 2) where two antennas are arranged so as not to become an obstacle with each other at the time of communication, rotation mechanisms (movable portions) for the directional adjustment are required in five places. However, with the invention of the first gist, since a part of the direction adjusting mechanism is shared, it is sufficient to have the rotation mechanisms (movable portions) for the directional adjustment in four places, thus making the construction simple.

According to the construction of the second and third gist, the two antennas do not become an obstacle with each other at the time of communication, and they can be set up in a well-balanced state. According to the fourth gist, direction control of the antenna becomes easy.

According to the construction of the fifth and sixth gist, the shape of the antenna is bilaterally symmetrical around the axis, and the rotation moment is easily balanced.

According to the construction of the seventh gist, since the third antenna can be utilized as a backup antenna, adjustment of the antenna gain and directivity and the like, such as quality deterioration of the transmission line and change of the directivity becomes possible, while communicating with two communication targets.

According to the construction of the eighth gist, since the radio lens is fixed and only the primary radiator (converter) is moved, the driving load of the antenna can be made smaller than the case where both the radio lens and the converter are moved.

According to the construction of the ninth, tenth and eleventh gist, the function of the planar antenna is provided on the both faces or multiple faces in the antenna portion in the antenna mechanism. Hence, it becomes possible to reduce the operating range for adjusting the direction of the antenna for directing the antenna to the communication target, thereby enabling faster and more reliable signal transmission and reception.

That is to say, by laminating two antennas back to back, by providing an antenna face on the side of a polyhedral support (polyhedron shape), by arranging these antennas in parallel or the like, the movement range can be reduced when the antenna is directed to the communication target, hence there is an effect in communicating with the communication target in the winking of an eye.

According to the construction of the twelfth and thirteenth gist, by having antennas with different properties, transmission and reception to/from satellites having a different frequency band to be used and polarized electromagnetic radiation become possible at the same time.

According to the construction of the fourteenth to seventeenth gist, by providing an antenna exclusive for the reception, the position of the next satellite can be roughly decided, and it is very effective when the weather condition in the sky is bad, and the reception power can be gained by following another satellite rather than following the current satellite (from the direction of the antenna, the reception power which could be obtained at that time can be seen), when the antenna has lost sight of the satellite, and when the position of the antenna is to be acquired at the time of initial setup of the antenna.

DESCRIPTION OF THE PREFERRED EMBODIMENTS

Next is a description of embodiments of the present invention with reference to the accompanying drawings

[First Embodiment]

Figure 1:
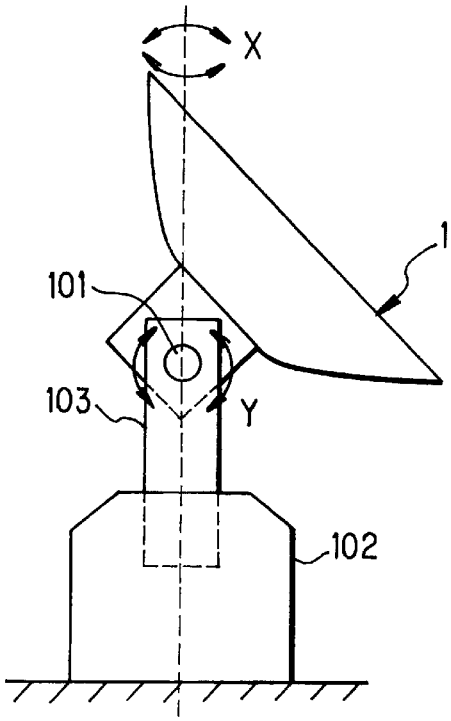
FIG. 1 PRIOR ART
FIG. 1 is a diagram showing a main part of a conventional antenna system.
Figure 2:
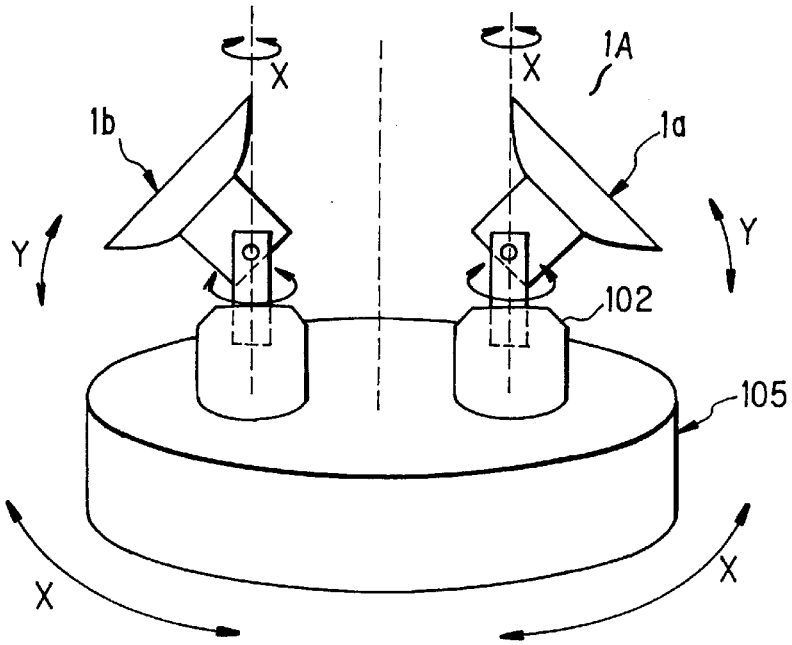
FIG. 2 PRIOR ART
FIG. 2 is a diagram of a conventional antenna system.
Figure 3:
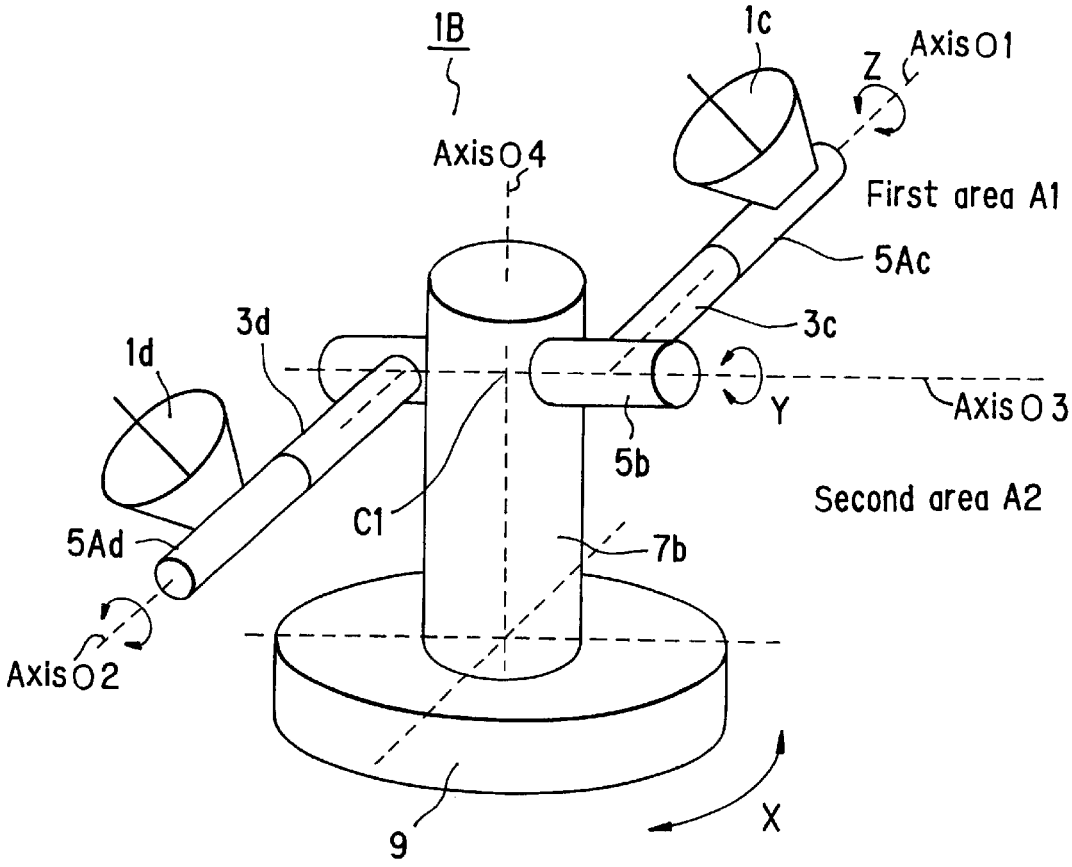
FIG. 3 is a perspective view showing a schematic construction of a first embodiment of the antenna system according to the present invention.

FIG. 3 is a schematic perspective view of an antenna system 1B according to a first embodiment of the present invention.

The antenna system 1B has: two parabolic antennas 1*c* and 1*d*; rotation mechanisms 5A*c* and 5A*d* for mounting the parabolic antennas 1*c* and 1*d* in a fixed condition and rotatably supported by brackets (supporting members) 3*c* and 3*d* around the central axes O1 and O2 in the longitudinal direction; an elevation angle adjusting mechanism 5*b* for commonly supporting the two brackets 3*c* and 3*d*; a support 7*b* for horizontally supporting the elevation angle adjusting mechanism 5*b*; and a turntable 9 for arranging the support 7*b* in a standing condition.

The central axis in the longitudinal direction of the brackets 3*c* and 3*d* coincides with the axis O1 and O2 of the rotation mechanisms 5A*c* and 5A*d*.

The elevation angle adjusting mechanism 5*b* is supported by the support 7*b* rotatably around the central axis O3 in the longitudinal direction. The brackets 3*c* and 3*d* supported by the elevation angle adjusting mechanism 5*b* are disposed in symmetrical positions with respect to the node C1 of the axis O3 and the axis O4, so that their axes O1 and O2 become parallel.

The rotation center axis O4 of the turntable 9 coincides with the central axis in the longitudinal direction of the support 7*b*.

With the above described construction, the turntable 9 becomes a rotation mechanism for changing the azimuth angle X of the parabolic antennas 1*c* and 1*d* (the angle of the axes O1 and O2 projected on a horizontal plane), by means of the rotation thereof centering around the axis O4. Moreover, the elevation angle adjusting mechanism 5*b* becomes a rotation mechanism for changing the elevation angle Y of the parabolic antennas 1*c*, 1*d* and bracket 3*c*, 3*d* (the angle between the axes O1, O2 and the horizontal plane), by means of the rotation thereof centering around the axis O3. Moreover, the rotation mechanisms 5A*c* and 5A*d* becomes a rotation mechanism for changing the rotation angle direction Z of the parabolic antennas 1*c*, 1*d* (the angle of the circumferential direction centering around the axis O1, O2), by means of the rotation thereof independently and respectively centering around the axis O1, O2. Then, the axis O1 of the bracket 3*c*, the axis O3 of the elevation angle adjusting mechanism 5*b*, and the axis O4 of the turntable 9 are respectively in the vertical direction to each other, and by rotating each axis optionally, the antennas 1*c* and 1*d* can be directed to the optional direction within the three-dimensional space.

Moreover, the independent antennas 1*c*, 1*d* share the axis O3 of the elevation angle adjusting mechanism 5*b* and the axis O4 of the turntable 9, while the rotation of the first rotation mechanism 5A*c* and the second rotation mechanism 5A*d* can be adjusted separately and independently around the respective axes O1 and O2. Therefore, respective antennas 1*c* and 1*d* can be directed to the separate direction at the same time, enabling to direct the antennas to communication targets in two different directions.

Furthermore, the rotation mechanisms 5A*c* and 5A*d* have their axes O1 and O2 in parallel and are separately arranged in the first and second areas A1 and A2 partitioned by a plane obtained including the axis O3 and running in parallel to axis O4. In other words, the brackets 3*c* and 3*d* are arranged and mounted so that the axes O1 and O2 become parallel to each other, and a normal drawn from the one bracket does not cross the other bracket, that is, non-facing state each other. Thereby, even if the antennas 1*c* and 1*d* rotate around each axes O1 and O2 by means of each rotation mechanism 5A*c* and 5A*d*, the one antenna and its rotation axis are not located on the whole face of the other antenna, hence they do not become an obstacle to each other's communication.

Furthermore, described detailed in this embodiment of the invention, the axes O1 and O2 are provided print-symmetrically with respect to the intersection of the axes O3 and O4, so that the two antennae do not become an obstacle to each other at the time of communication, and they can be set up in a well-balanced state.

With this embodiment, the directivity of the antennas 1*c* and 1*d* is set to be in the vertical direction to the axes O1 and O2, respectively, so that reliably they do not become an obstacle to the communication of the other antenna with each other. However, the directivity of the antennas 1*c* and 1*d* is not limited to the vertical direction to the axes O1 and O2, and may be optionally selected, considering the relative disposed position and size of the antenna, so that the antennas do not become an obstacle to each other's communication.

One example of the direction adjusting control system of the antenna system 1B will be described with reference to the block diagram of FIG. 4.

The direction adjusting control system of the antenna system 1A has an orbit information memory 11, a setting position information memory 13, a real-time clock 15, an elevation angle/azimuth angle calculation section 17, a rotation angle calculation section 19 of each axis, a pulse generation section 21 and an antenna driving section 23, for enabling to control the direction of the antenna.

The orbit information memory 11 is a memory as a section for storing the orbit information of each satellite.

The setting position information memory 13 is a memory as a section for storing the information of the position where the antenna is set up.

The real-time clock 15 is a clock from which other blocks can read the time information.

The elevation angle/azimuth angle calculation section 17 is a calculation section which shows the position of a satellite at a specified time as seen from the antenna setting position by an elevation angle and an azimuth angle, based on various data of the orbit information memory 11, the setting position information memory 13 and the real-time clock 15. The calculation result is input to the rotation angle calculation section for each axis 19.

The rotation angle calculation section for each axis 19 is a processing section for calculating the angle for rotating the rotation mechanisms 5A*c* and 5A*d*, the elevation angle adjusting mechanism 5*b*, and the turntable 9 with regard to each axis O1, O2, O3 and O4, respectively, to direct the antenna to the direction of a satellite, based on the elevation angle data and the azimuth angle data of the satellite position determined by the elevation angle/azimuth angle calculation section 17.

The pulse generation section 21 generates a pulse to be transmitted to the motor which controls each axis, based on the rotation angle data of each rotation axis determined by the rotation angle calculation section for each axis 19.

The antenna driving section 23 is a driving section for driving the motor for each axis based on the pulse data from the pulse generation section 21.

Figure 5:
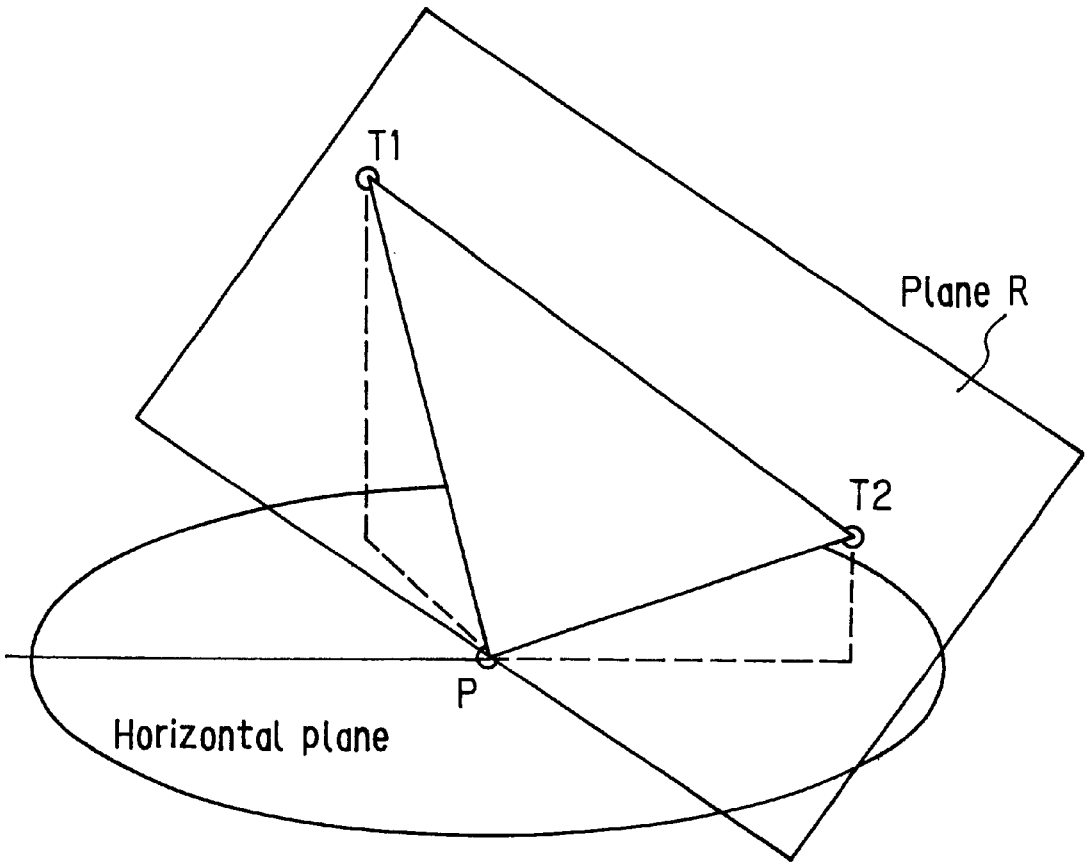
FIG. 5 is a diagram showing the principle of directional adjustment of the antenna system according to the first embodiment.

As for the substantial control of the antenna direction, the following processing steps S1 to S3 are performed in the elevation angle/azimuth angle calculation section 17 and the rotation angle calculation section 19, based on the data read from the orbit information memory 11, the setting position information memory 13 and the real-time clock 15 (see FIG. 5).

(Step S1) The three current positions of the communication targets T1, T2 and the own station P are acquired.

(Step S2) A triangle T1•T2•P formed by the three positions of the communication targets T1, T2 and the own station P is defined.

(Step S3) A plane R parallel to the triangle T1•T2•P is defined, to determine the azimuth angle X of the turntable 9, the elevation angle Y of the elevation angle adjusting mechanism 5*b*, and the rotation angle Z of the rotation mechanisms 5A*c* and 5A*d*, so that the axes O1 and O2 of the rotation mechanisms 5A*c* and 5A*d* are orthogonal to the plane R. Then, the following step S4 is performed in the pulse generation section 21 and the antenna driving section 23, based on the calculation results of the elevation angle Y, the azimuth angle X and the rotation angle Z determined in the step S3. (Step S4) The turntable 9, the elevation angle adjusting mechanism 5*b* and the independent rotation mechanisms 5A*c* and 5A*d* are rotated based on the calculation results of the elevation angle Y, the azimuth angle X and the rotation angle Z, to thereby adjust the antennas 1*c* and 1*d* so that these antennas face the communication targets T1 and T2, respectively.

The antennas 1*c* and 1*d* are directed to the two communication targets T1 and T2 in the order described above.

At this time, the two antennas 1*c* and 1*d* can be directed to either of the communication targets T1 or T2, and when the position of the communication targets T1 and T2 crosses, the combination of the communication target and the antenna can be easily changed.

The first embodiment of the present invention has been described above in detail. Below is a description of the other embodiments with reference to schematic drawings. In addition, the same reference numerals are given to the construction similar to those of the above described embodiment, and the description thereof is omitted.

[Second Embodiment]

Figure 6:
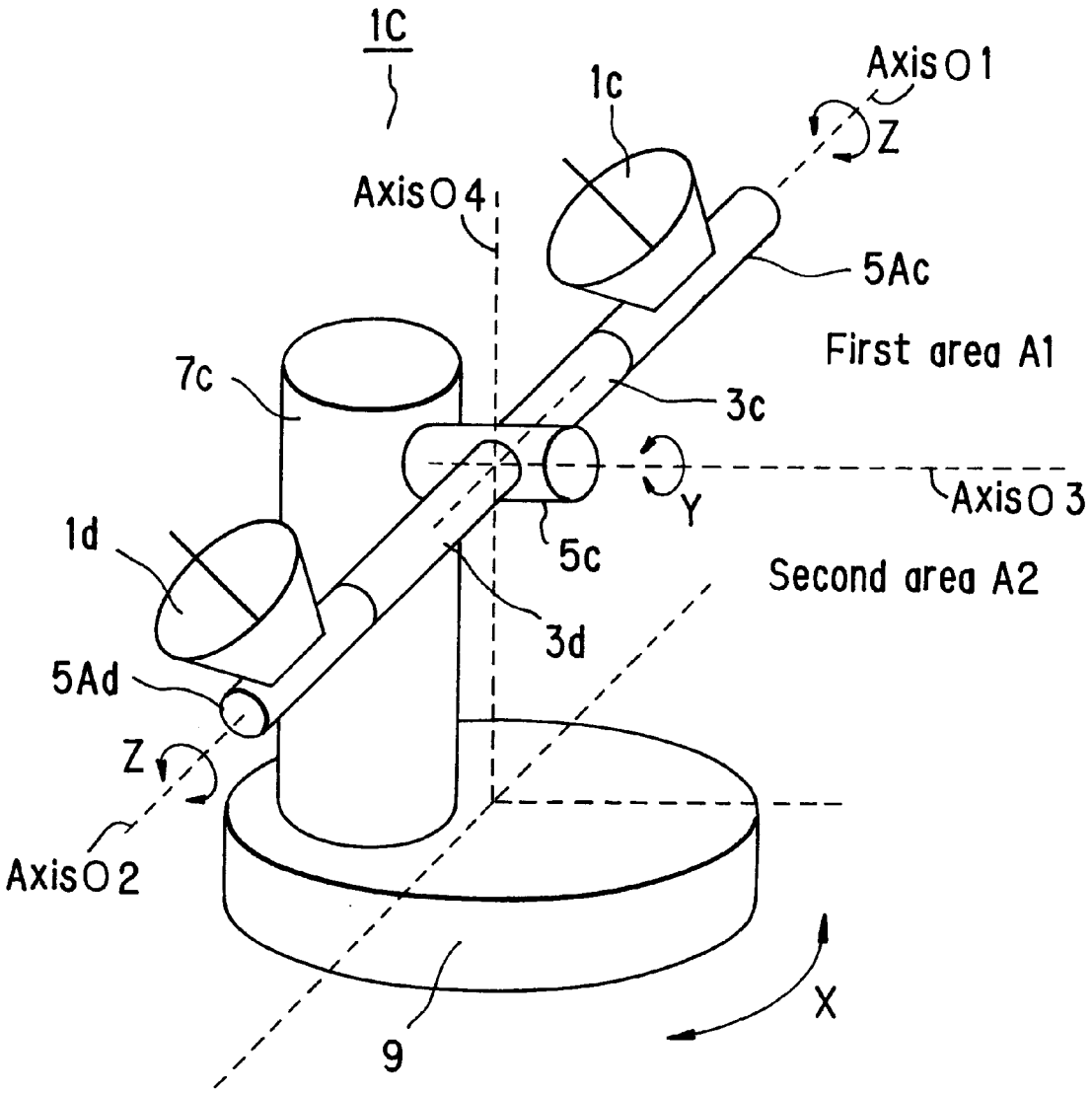
FIG. 6 is a perspective view showing a schematic construction of a second embodiment of the antenna system according to the present invention.

FIG. 6 shows a second embodiment of an antenna system 1C according to the invention of this application. Incidentally, the second embodiment is formed by changing the position of brackets 3*c* and 3*d* in the first embodiment, and the same reference numerals are given to the construction similar to those of the first embodiment and the description thereof is omitted.

That is to say, not only the first embodiment but it is also possible that the axes O1 and O2 may be provided symmetrically with respect to the plane containing the axis O4 and running in parallel to the axis O3.

The first bracket 3*c* and the second bracket 3*d* for mounting the antennas are arranged so that their axes O1 and O2 coincide with each other, namely, they are arranged coaxialy, and mounted to the support 7*c* via the elevation angle adjusting mechanism 5*c* for changing the elevation angle Y of the brackets. Moreover, the support 7*c* is arranged upright at a position deviated from the rotation center, on the turntable 9 for changing the azimuth angle X of the bracket.

Then, the two parabolic antennas 1*c* and 1*d* have respectively independent rotation mechanisms 5A*c* and 5A*d*, centering around the axis O1 (the axis O2 arranged with O1 coaxialy), and it is possible to direct the antenna to any direction, since there are three direction control mechanisms for each antenna.

Additionally, as shown in FIG. 6, it is so arranged that the antennas 1*c*, 1*d* and brackets 3*c*, 3*d* do not exist in the space between the communication targets T1, T2 (see FIG. 5) and antennas 1*c*, 1*d*. That is to say, since antennas 1*c*, 1*d* and brackets 3*c*, 3*d* are arranged so as not to face each other, the other antenna and brackets 3*c*, 3*d* serving as the supporting member do not become an obstacle to the communication to the both antennas, hence it becomes possible to direct the antennas to different communication targets.

In addition, with the present invention, the properties of the first antenna 1*c* and the second antenna id may be the same, but the properties of the first antenna 1*c* and the second antenna 1*d* are made to be different, thereby it is possible to simultaneously correspond to not only the positions of the communication targets T1 and T2, but also two systems having a different frequency band to be used and polarized electromagnetic radiation, such as CS (communications satellite) and BS (broadcast satellite) and the like (e.g. it is possible to perform reception or communication).

Furthermore, the direction adjustment control system of the antenna systems 1C of the third embodiment, and the processing procedure for controlling the specific direction of the antenna are the same as those of the former embodiment, hence the description thereof is omitted.

As described detailed in this first and second embodiments, especially, the axes O3 and O4 are orthogonal to each other, and the axes O1 and O2 are orthogonal to the plane containing the axes O3 and O4, so that the two antennae do not block each other at the time of communication, and they can be set up in a well-balanced state. Thus, the direction control of antenna become easy.

[Third Embodiment]

Figure 7:
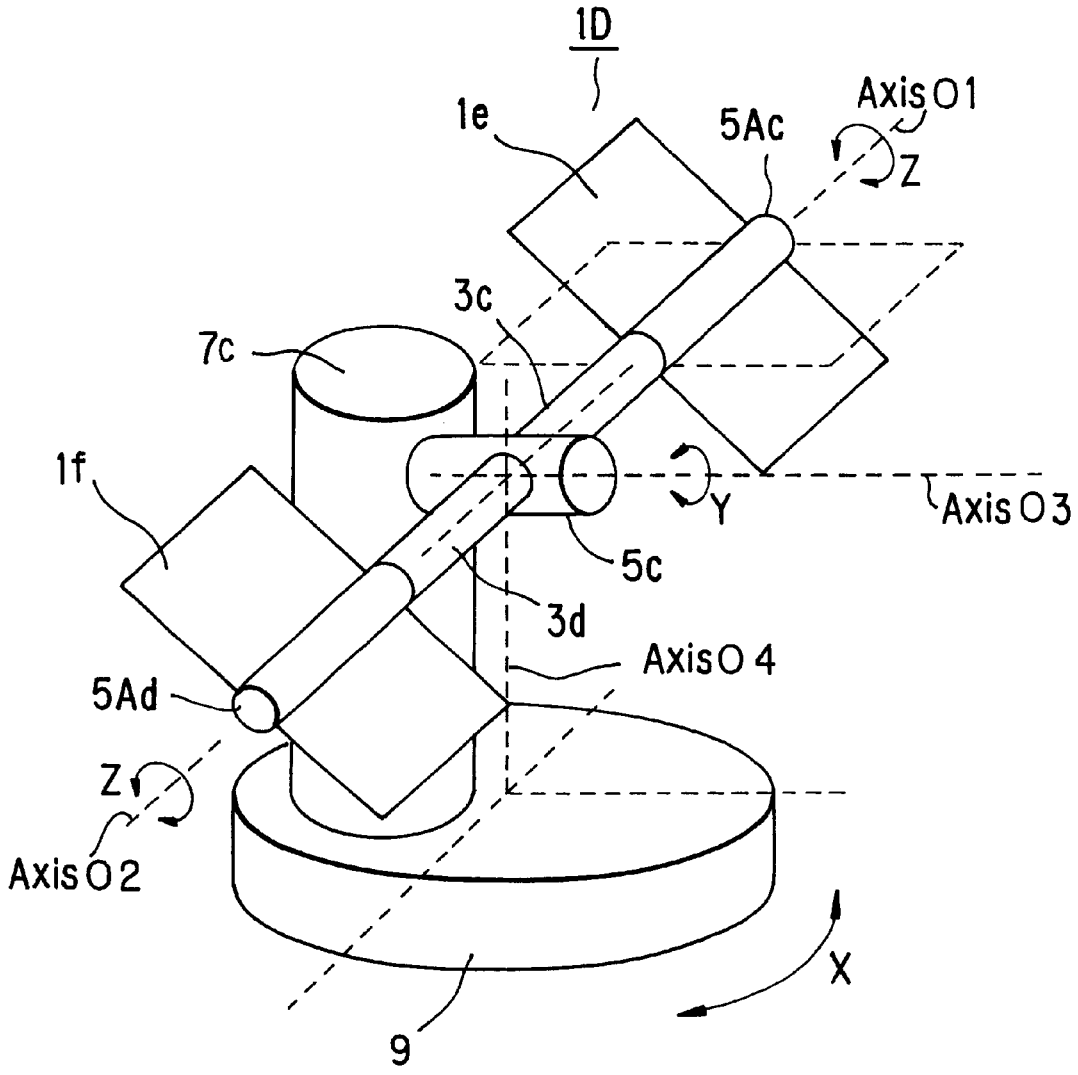
FIG. 7 is a perspective view showing a schematic construction of a third embodiment of the antenna system according to the present invention.

FIG. 7 shows a third embodiment of the antenna system 1D according to the present invention of this application. Incidentally, the third embodiment changes the parabolic antennas 1*c*, 1*d* of the first embodiment to planar antennas 1*e*, if, and the same reference numerals are given to the construction similar to those of the above described embodiment, and the description thereof is omitted.

The first bracket 3*c* and the second bracket 3*d* for mounting the antenna are arranged so that the axes O1 and O2 coincides with each other, and the planar antennas 1*e*, 1*f* shown in FIG. 7 are bilaterally symmetrical with respect to the axes O1 and O2, and constructed so that the axes O1 and O2 penetrate the center of gravity of the planar antennas 1*e*, 1*f*.

[Fourth Embodiment]

Figure 8:
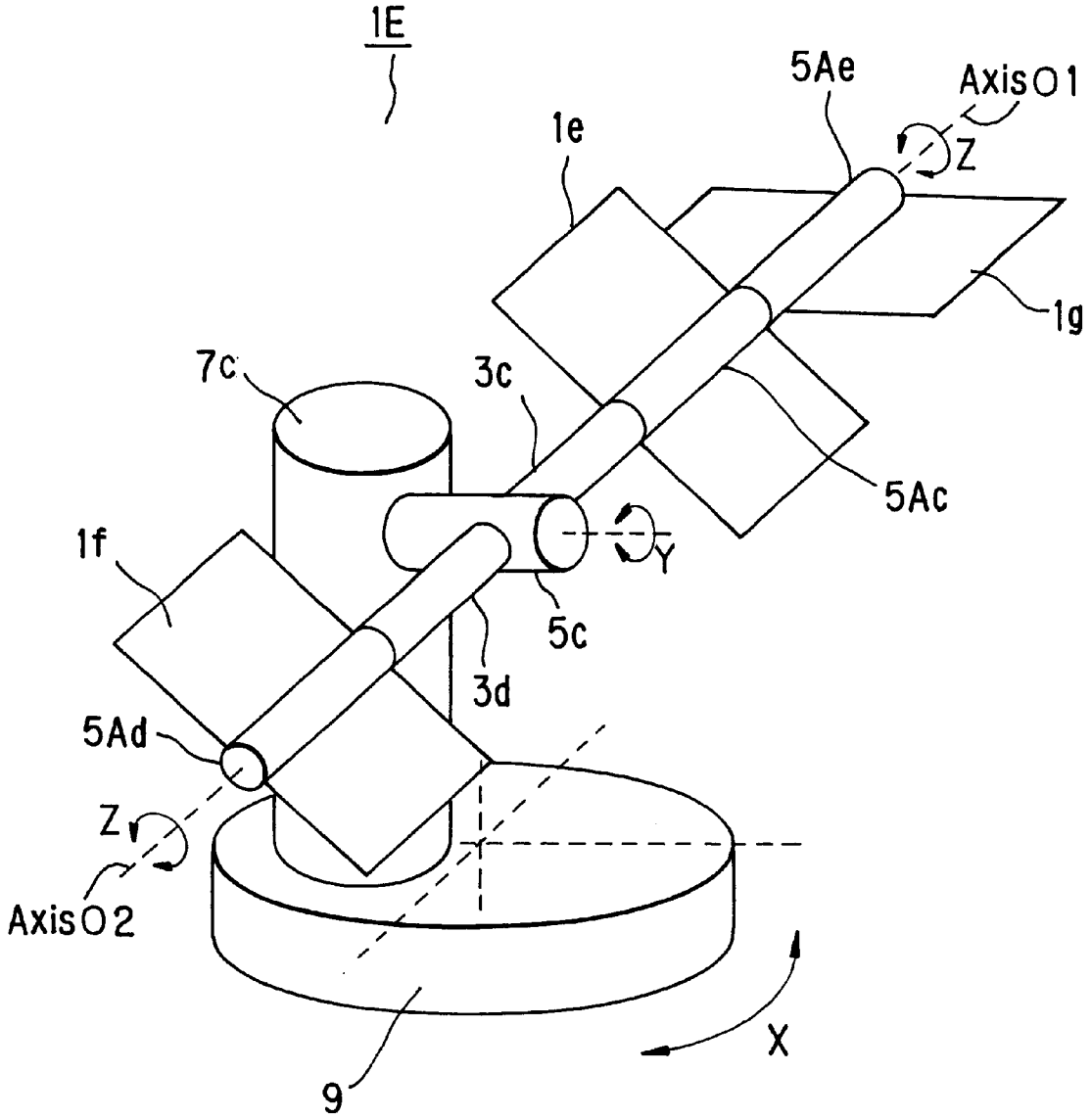
FIG. 8 is a perspective view showing a schematic construction of a fourth embodiment of the antenna system according to the present invention.

FIG. 8 shows a fourth embodiment of the antenna system 1E according to the present invention. Incidentally, the fourth embodiment adds a planar antenna to the third embodiment, and the same reference numerals are given to the construction similar to those of the above described embodiment, and the description thereof is omitted.

With the antenna system 1E, the third antenna 1*g* is provided on the rotation mechanism 5A*e* around the first bracket 3*c* or the second bracket 3*d* for supporting the antenna so that the attachment position thereof is different from that of the first antenna 1*e* and the second antenna 1*f*. The rotation mechanism 5A*e* for rotating the third antenna 1*g* is provided so that the rotation axis thereof coincides with the axis O1.

With this embodiment, the third antenna 1*g* has an independent rotation mechanism 5A*e*, hence it can be directed to any direction different from that of the first and second antennas (antennas 1*e*, 1*f*).

Therefore, when increase of the antenna gain and higher directivity of the antenna and the like are desired due to deterioration of the circuit state of the first and second antennas 1*e*, 1*f* or the like during communication, the third antenna 1*g* is directed to the same direction as that of the antenna 1*e* or 1*f*, as required, to thereby synthesize the received signal of the antenna 1*e* or 1*f* with the received signal of the antenna ig. Hence, it can correspond to the deterioration of the circuit state or to the request of higher directivity of the antenna.

Moreover, it is also possible to use the third antenna ig as a pilot antenna for searching the approximate direction of a new communication target, at the time of the change of the communication target, by changing the properties (directivity and/or frequency characteristic) of the third antenna 1*g* so as to become different from those of the first and the second antennas 1*e* and 1*f*. It is described in detail in the eleventh embodiment described later.

Figure 9:
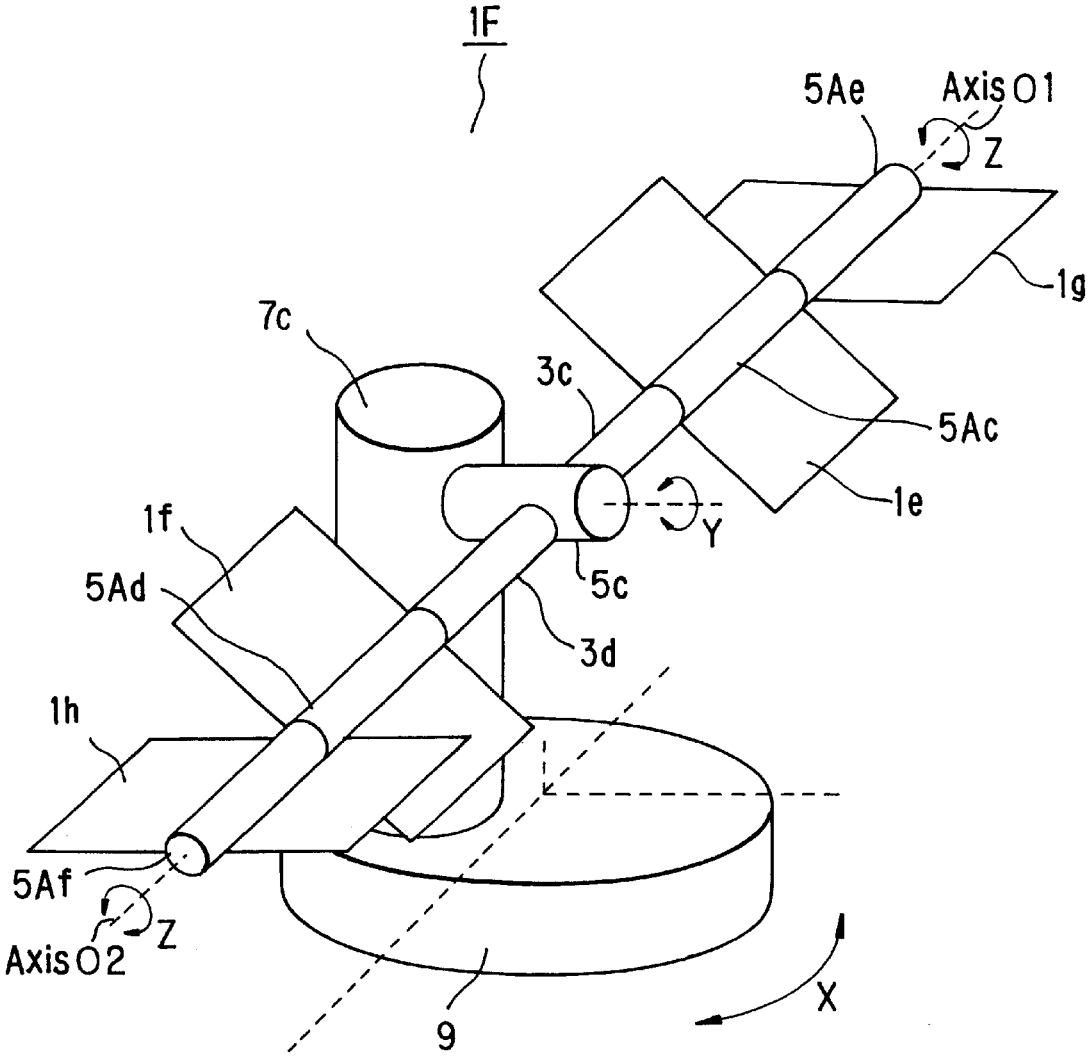
FIG. 9 is a perspective view showing a modification example of the fourth embodiment of the antenna system according to the present invention.

FIG. 9 is a modified array of the fourth embodiment. This example is an antenna system 1F having four planar antennas, two on the first bracket 3*c* and two on the second bracket 3*d*.

In this embodiment, the size and the shape of the first to the fourth antennas le to lh mounted on the brackets 3*c* and 3*d* are the same, and they are mounted so that good balance is maintained with respect to the elevation angle adjusting mechanism 5*c* which is an angle adjusting mechanism of the elevation angle Y of the bracket. Moreover, by changing the combination of the first to the fourth antennas 1*e* to 1*h* directed to the first communication target T1 and the second communication target T2, the space diversity effect can be also obtained. In addition, the rotation mechanism 5A*f* is a rotation mechanism provided in the fourth antenna lh and is rotatably disposed with respect to the bracket 3*d*, designating the rotation axis in the center of the longitudinal direction as the axis O2.

[Fifth Embodiment]

Figure 10:
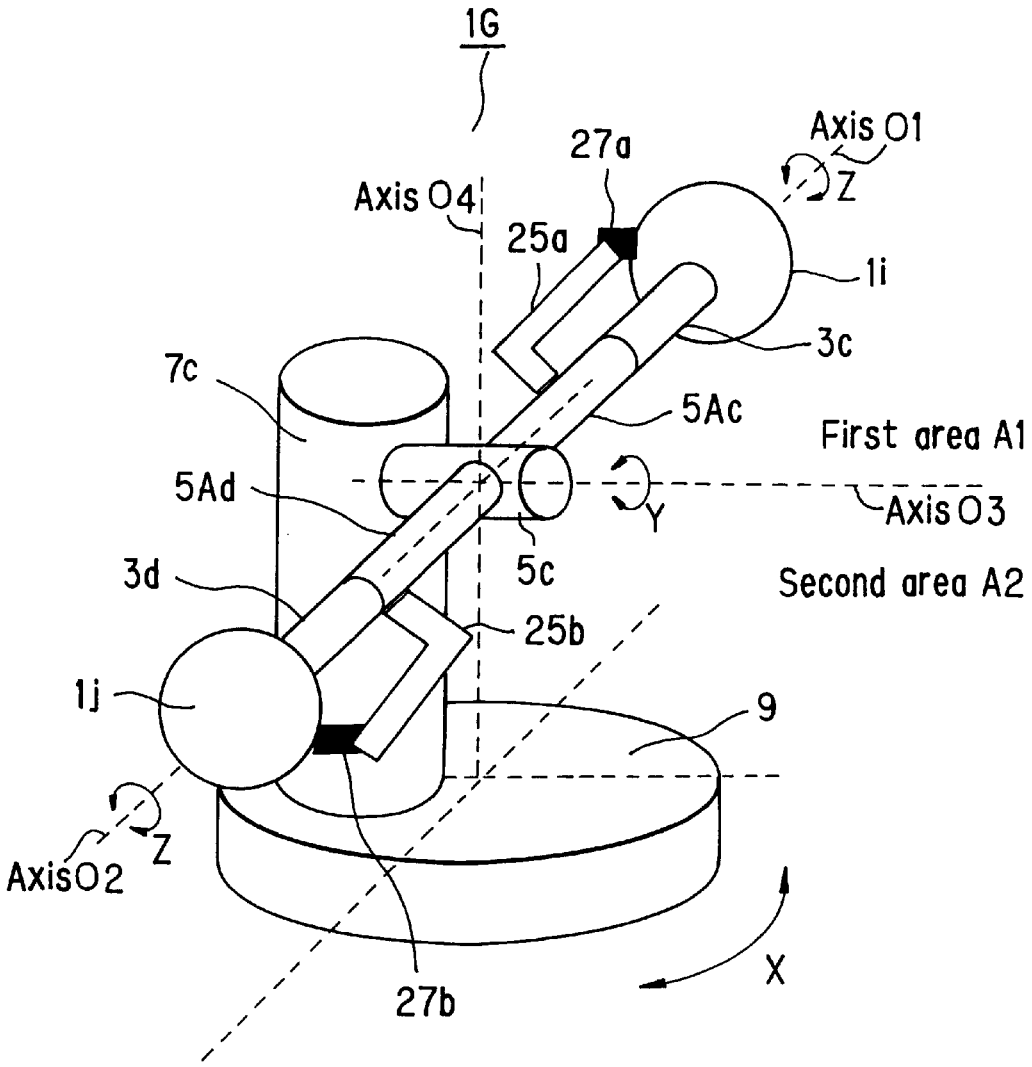
FIG. 10 is a perspective view showing a schematic construction of a fifth embodiment of the antenna system according to the present invention.

FIG. 10 shows the fifth embodiment of the antenna system IG according to the present invention.

With the fifth embodiment, the planar antenna in the second embodiment is changed to a radio lens, and the same reference numerals are given to the construction similar to those of the above described embodiment, and the description thereof is omitted.

The first radio lens li and the second radio lens 1*j*, both having a spherical shape, are mounted at the end of respective brackets 3*c* and 3*d* so that the axes 01 and 02 penetrate the center thereof.

A first primary radiator 27*a* is a first primary radiator (converter) for receiving radio wave collected by the first radio lens 1*i*, and a second primary radiator 27*b* is the second primary radiator (converter) for receiving radio wave collected by a second radio lens 1*j*.

The first primary radiator 27*a* and the second primary radiator 27*b* are connected to a L-shaped supporting members 25*a* and 25*b* disposed on the rotation mechanisms 5A*c* and 5A*d*, so as to follow the trajectory connecting the forcus point of the radio lenses 1*i* and 1*j*, existing in a plane orthogonal to the axis O1, O2 including the center of each radio lens 1*l*, 1*j*. Therefore, the first and second primary radiators 27*a*, 27*b* rotate around the periphery of each radio lens centering on the axis O1, O2, working with the rotation of the rotation mechanisms 5A*c* and 5A*d*.

The rotation of the antenna in this embodiment is realized not by rotating the radio lenses 1*i* and 1*j* themselves, but rotating the first and second primary radiators 27*a*, 27*b* around the periphery of each radio lens.

Therefore, each radio lens 1*i*, 1*j* itself does not rotate, and only the primary radiators 27*a* and 27*b* rotate, hence the driving load can be made small compared to the case where the whole antenna is rotated.

In addition, in this embodiment, the axis O1 of the first bracket 3*c* coincides with the axis O2 of the second bracket 3*d*. However, they may be arranged so as to become parallel to each other.

[Sixth Embodiment]

Figure 11:
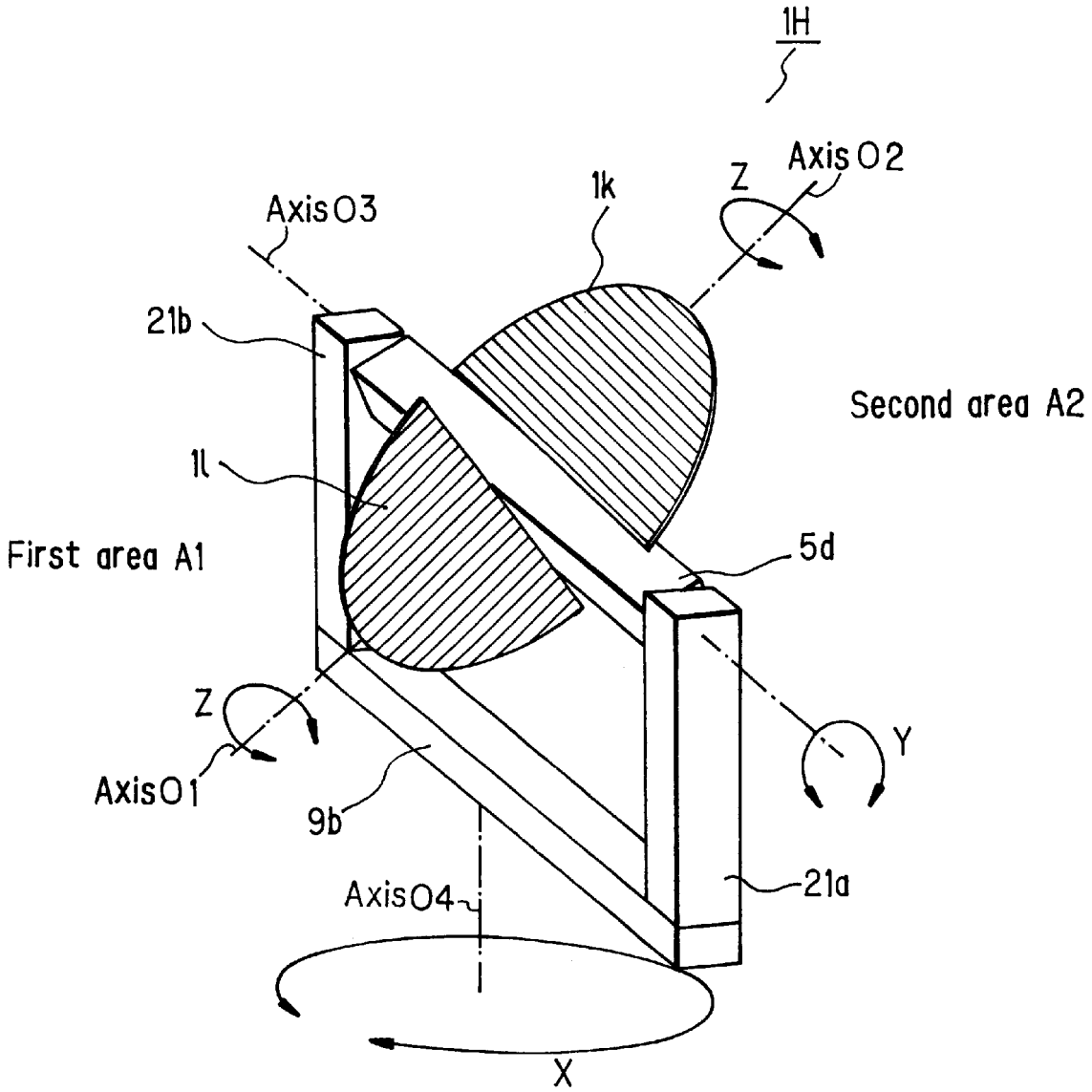
FIG. 11 is a perspective view showing a schematic construction of a sixth embodiment of the antenna system according to the present invention.

FIG. 11 shows the sixth embodiment of the antenna system 1H according to the present invention. The same reference numerals are given to the construction similar to those of the above described embodiment, and the description thereof is omitted.

With this embodiment, antennas 1*k* and 1*l* in a half moon shape are mounted symmetrically with respect to the rotation axis O3 in the longitudinal direction of a bar-shaped elevation angle adjusting mechanism 5*d*. The half moon-shaped antennas 1*k*, 1*l* are rotatably disposed respectively independently around the axis O1 and the axis O2 facing toward the vertical direction with respect to the axis O3 of the elevation angle adjusting mechanism 5*d*. Incidentally, the bracket and the rotation mechanism for rotatably supporting the antennas 1*k* and 1*l* to the elevation angle adjusting mechanism 5*d* around the axis O1 and the axis O2 are not shown.

The elevation angle adjusting mechanism 5*d* is disposed rotatably around the rotation axis O3 on two supporting frames 7*d* fixed to a bar-shaped azimuth angle adjusting mechanism 9*a*. Therefore, by rotating the elevation angle adjusting mechanism 5*d* around the axis O3, the antennas 1*k* and 1*l* are rotated in the elevation angle Y direction.

Moreover, the azimuth angle adjusting mechanism 9*a* is mounted rotatably in the azimuth angle X direction, with the rotation axis O4 orthogonal to the axis O3.

With this embodiment, by making the antenna in a half moon shape, the necessary volume which is the undulation range of the antenna when each axis rotates can be made minimum.

Thereby, the antenna can be housed efficiently within a not-shown radome in a half moon shape.

Figure 12:
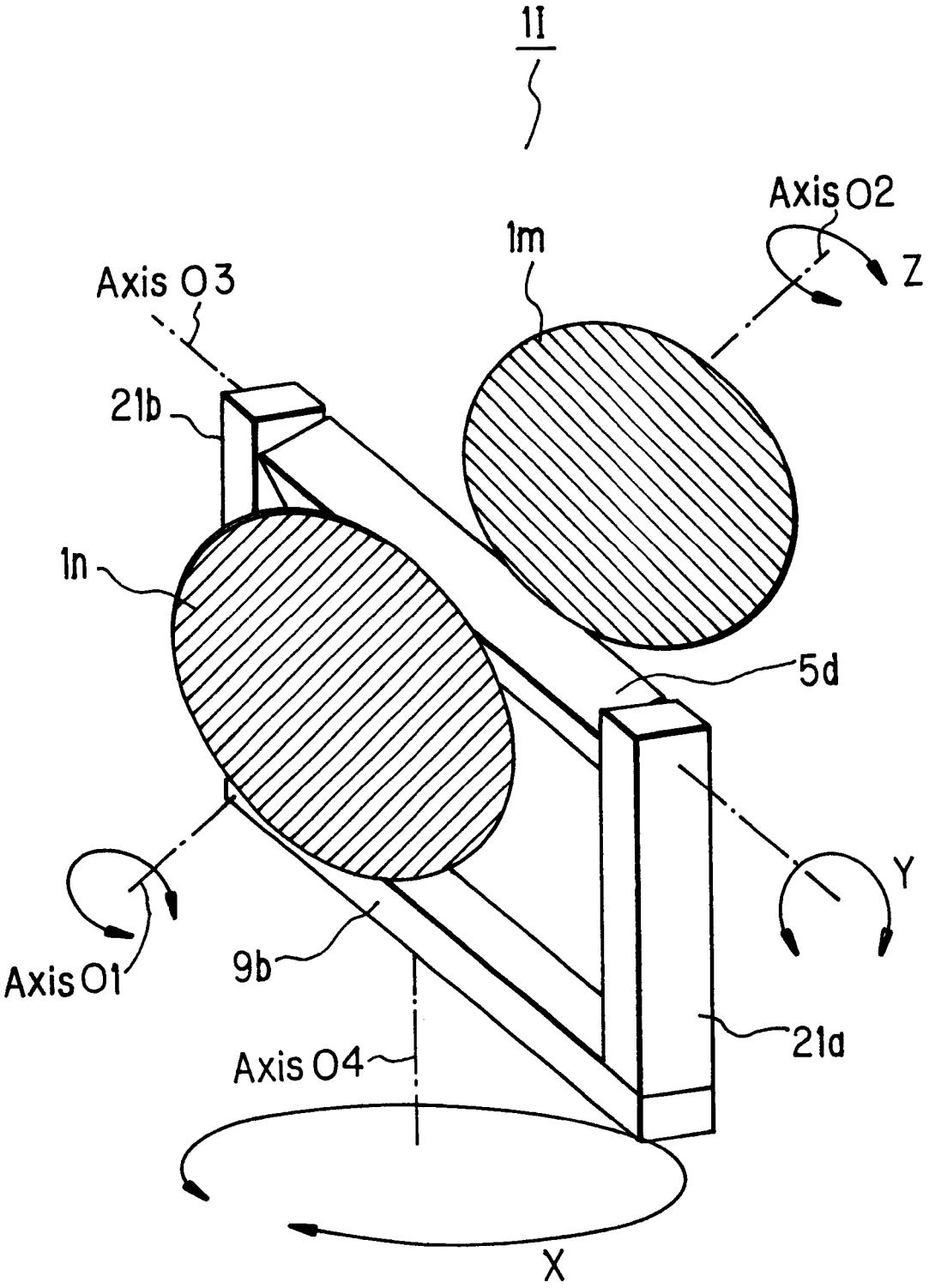
FIG. 12 is a perspective view showing a modification example of the sixth embodiment of the antenna system according to the present invention.

Furthermore, as shown in FIG. 12, the antenna shape may be changed from the half moon shape to an elliptic shape.

In general, when the antenna satisfies a certain gain, and when it is desired to restrain an unnecessary radiation (side lobe) other than a desired direction to less than a certain value, the antenna shape is desired to be a circular or elliptic shape. In the case of the circular antenna, however, the rotation radius of the antenna becomes large with respect to the obtained gain, hence the elliptic shape as in this embodiment is optimum.

[Seventh Embodiment]

The antenna system according to the seventh embodiment has such a construction that a planar antenna is provided on the back side of the planar antenna in the third embodiment or the like, and hand-over to the antenna which can adjust the communication with a satellite having a good communication state at an optimal time and by an optimal operation is made possible.

Figure 13:
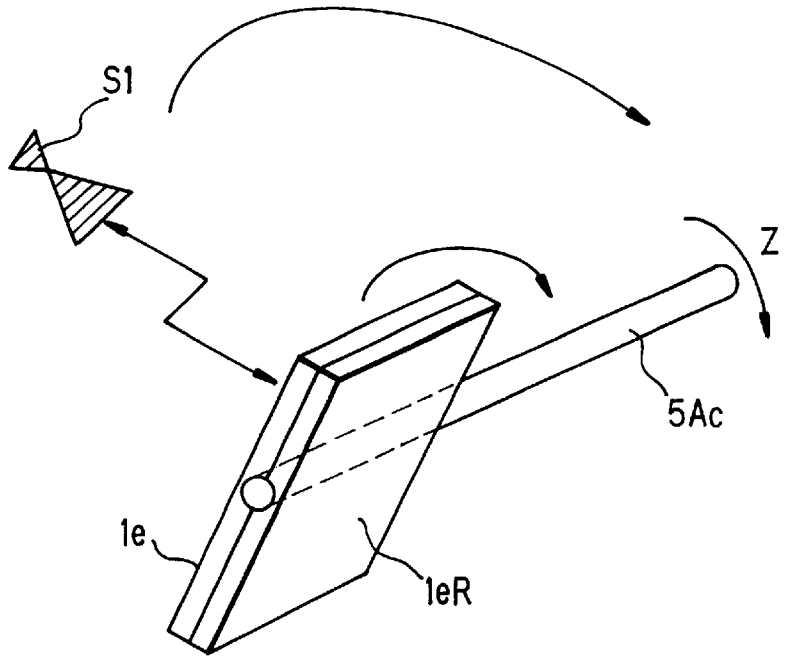
FIG. 13 is a perspective view showing an antenna portion of an seventh embodiment of the antenna system according to the present invention.
Figure 14:
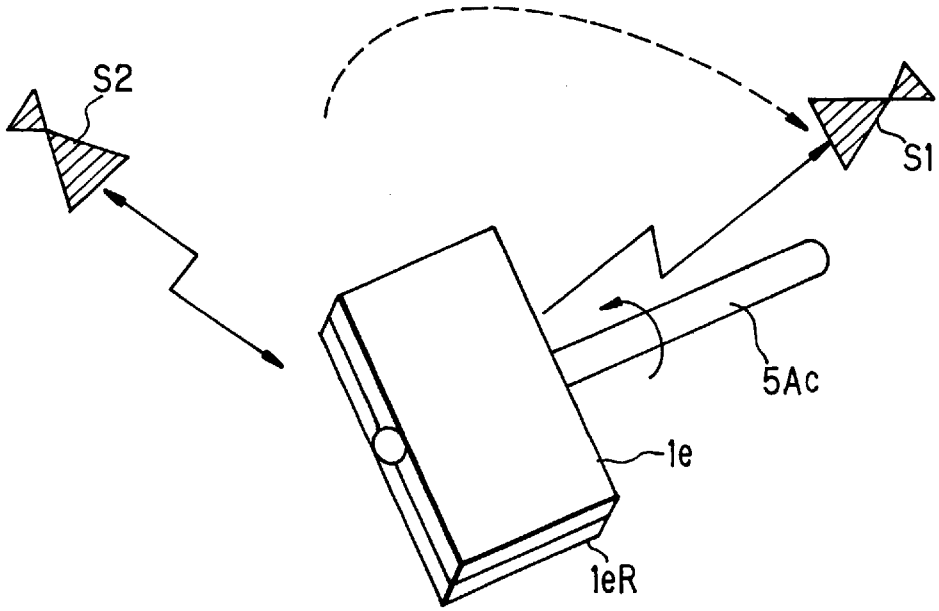
FIG. 14 is a diagram showing a case where in the antenna portion in the seventh embodiment, a new satellite S2 appeared, and the communication target is changed from the satellite S1 to the satellite S2.
Figure 15:
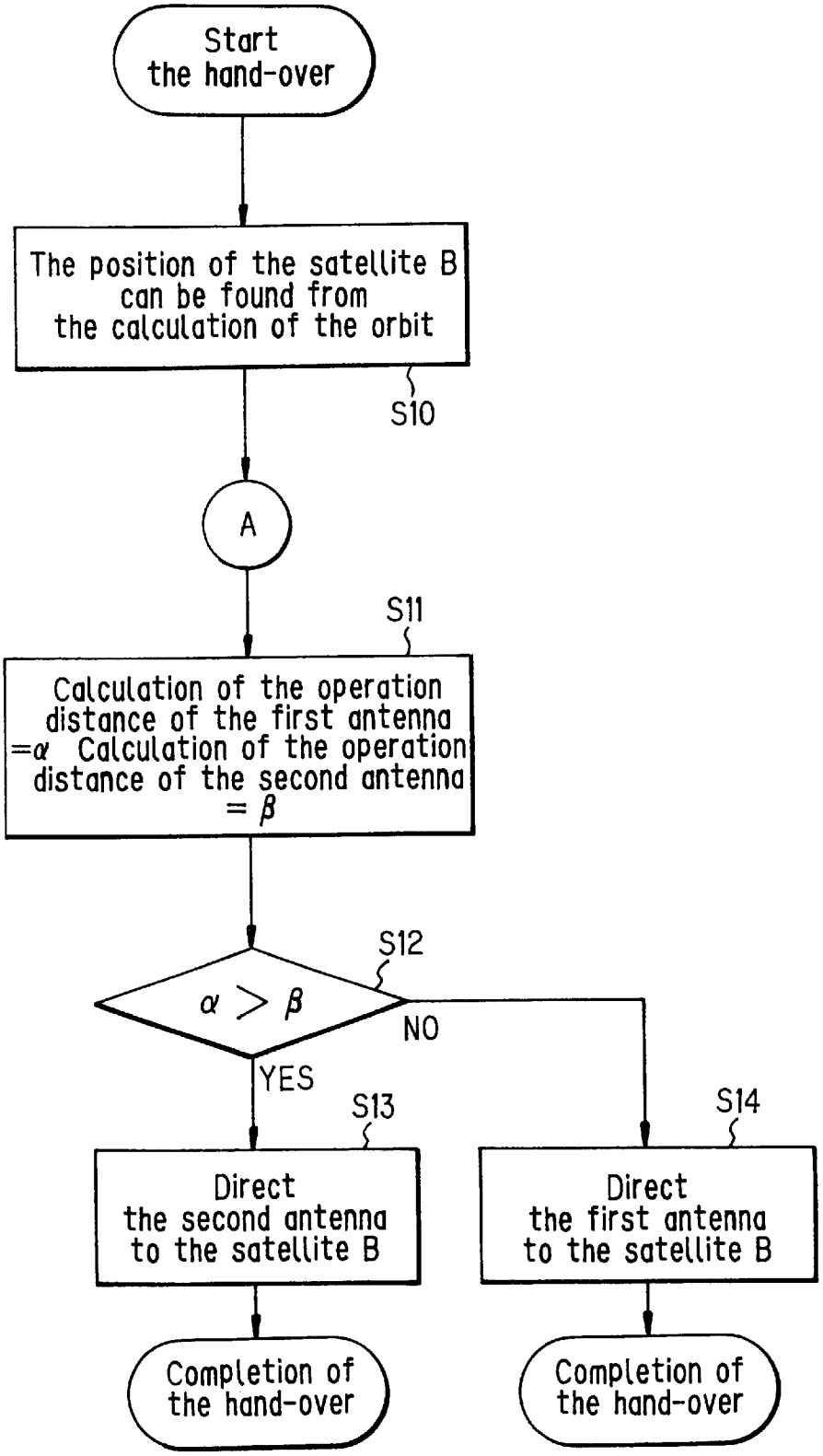
FIG. 15 is a flowchart at the time of the hand-over operation in the seventh embodiment.

FIG. 13 is a perspective view showing only one antenna portion, FIG. 14 is a perspective diagram showing a case where a new satellite S2 appeared, and the communication target is changed from the satellite SI to the satellite S2. FIG. 15 shows a flowchart at the time of the hand-over operation in FIG. 14.

Below is a description of the hand-over operation of the communication target with reference to the flowchart in FIG. 15. The same reference numerals are given to the construction similar to those of the above described embodiment, and the description thereof is omitted.

As shown in FIG. 13, an antenna same as that on the one side is attached back to back on a rotation mechanism 5A*c*, and the rotation mechanism 5A*c* supports them by penetrating the center thereof.

In FIG. 13, in the initial stage after the antenna set up, when a first antenna 1*e* communicates with a target satellite S1, the first antenna 1*e* follows the satellite S1.

Then, after the lapse of time, as shown in FIG. 14, a new satellite S2 appeared, and when the communication target is changed over from the satellite S1 to the satellite S2 (at the time of normal hand-over), since the position of the satellite S2 can be approximately determined by calculation (S10), the distance to direct the first antenna 1*e* to the satellite S2 (trajectory) and the distance to direct the second antenna 1*e*R to the satellite S2 can be calculated from the direction of the current antenna face (the first antenna le and the second antenna 1*e*R) (S11), to thereby adopt the antenna having a less operation distance (S12 to S14).

In FIG. 14, the operation range of the antenna can be reduced by taking the trajectory for directing the second antenna 1*e*R to the satellite S2, hence the second antenna 1*e*R follows the satellite S2 and perform communication therewith.

Figure 16:
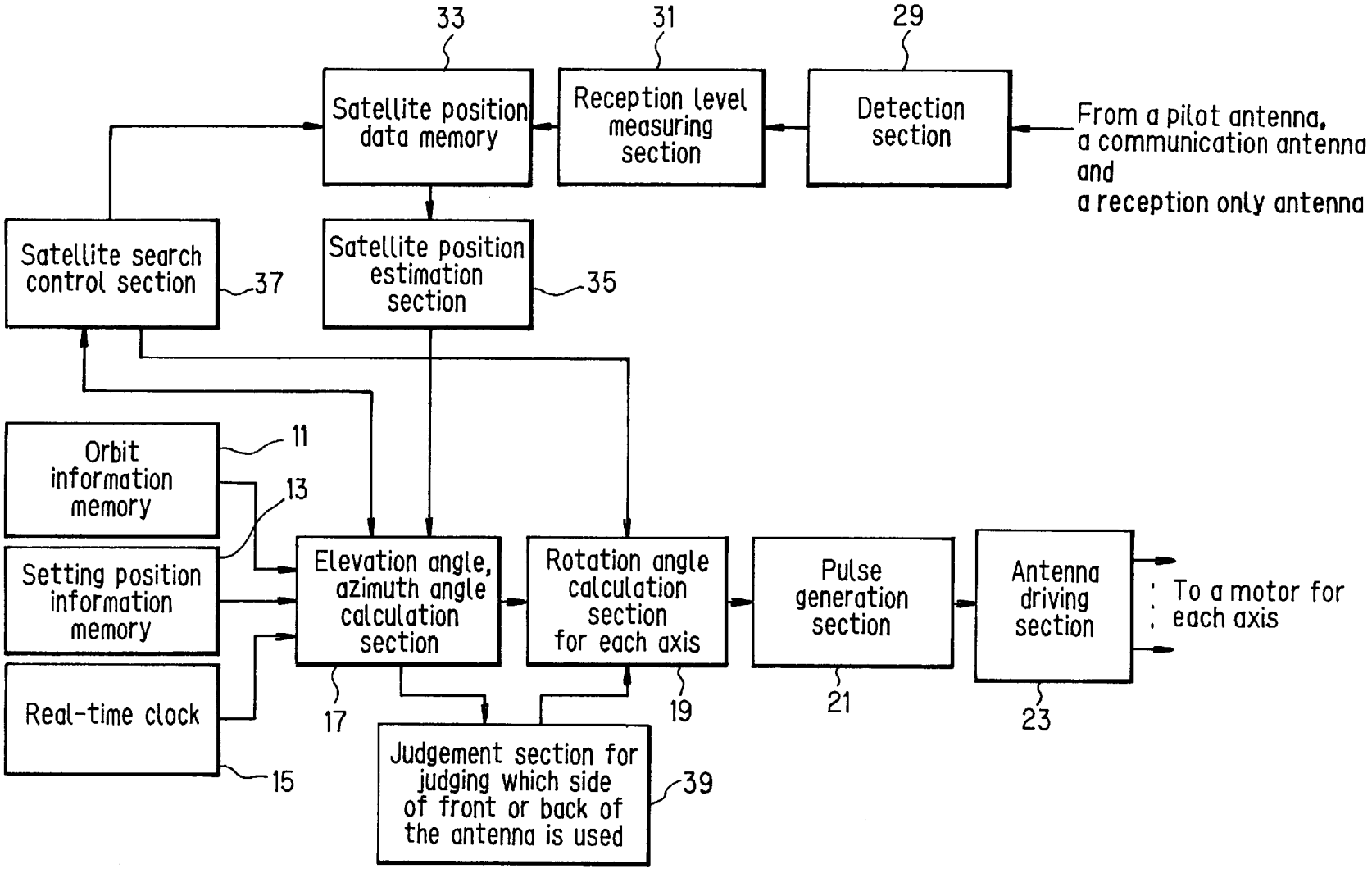
FIG. 16 is a block diagram showing the direction adjustment control system of the antenna system according to the seventh embodiment.

FIG. 16 shows a block diagram of the antenna system of this embodiment.

Figure 4:
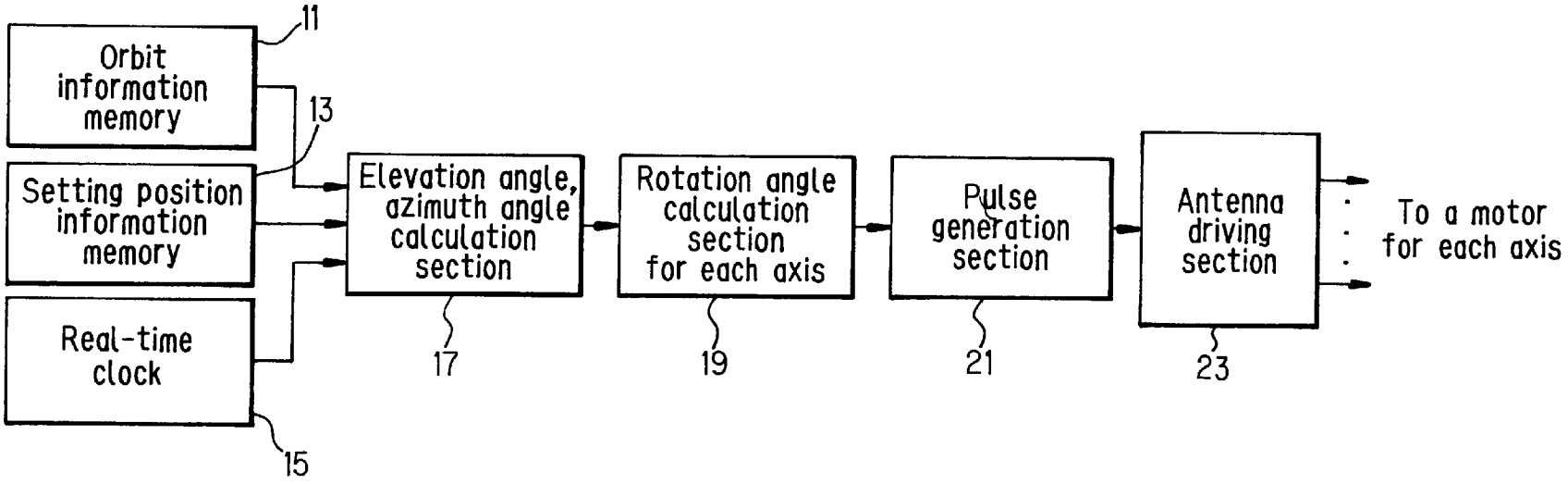
FIG. 4 is a block diagram of a direction adjustment control system of the antenna system according to the first embodiment.

The direction adjustment control system has a detection section 29, a reception level measuring section 31, a satellite position data memory 33, a satellite position estimation section 35, a satellite search control section 37 and a judgement section 39 for judging which side of front or back of the antenna is used, in addition to the construction of FIG. 4.

The detection section 29 is a detection section for detecting the signal input from each antenna.

The reception level measuring section 31 is a section for measuring the level of the reception signal.

The satellite position data memory 33 is a memory as a storage section for storing the intensity data of the reception signal, based on the reception signal level data from the reception level measuring section 31 and the control data from the satellite search control section 37.

The satellite position estimation section 35 estimates the satellite orbit from the intensity data of the reception signal stored in the satellite position data memory 33, and transmits data to the elevation angle/azimuth angle calculation section 17.

The satellite search control section 37 is a control section for performing the driving control of the antenna for searching a satellite, based on the elevation angle and the azimuth angle determined in the elevation angle/azimuth angle calculation section 17.

The judgement section 39 for judging which side of front or back of the antenna is used is a judgement section for judging which side of front or back of the antenna is to be used. In the above described case, the judgement section 39 receives the direction of the current antenna and the positional information of the satellite S2 from the elevation angle/azimuth angle calculation section 17, judges which side of front or back of the antenna is to be used, and transmits the judgement result to the rotation angle calculation section 19 for each axis.

Furthermore, at the time of hand-over, if the position of the satellite S2 cannot be estimated by the calculation of the orbit, the following two methods can be considered to acquire the position of the satellite B.

Figure 17:
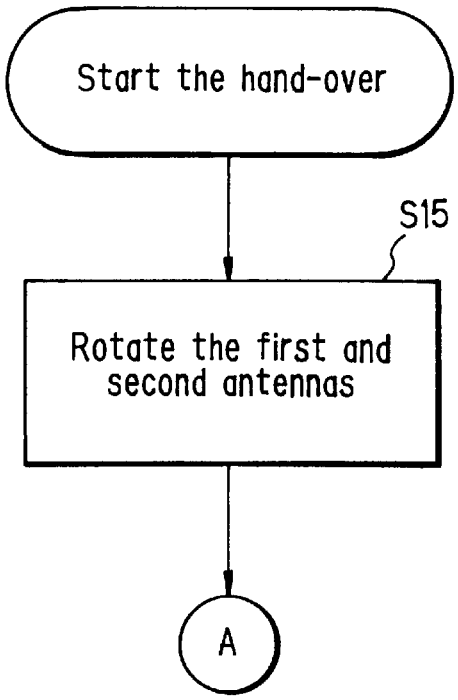
FIG. 17 is a flowchart of a first method in the case where the satellite orbit cannot be foreseen, at the time of the hand-over operation in the seventh embodiment.

A first method is to rotate the first and second antennas, as shown in FIG. 17 (S15), that is, the reception power is measured, the approximate position of the satellite is narrowed from the power distribution, and the antenna is further moved, to thereby find the position where the reception power becomes a prescribed value, that is, the satellite S2 can be acquired. The processing thereafter proceeds to S11 in FIG. 15.

In the case of the above described first method, the satellite S2 is acquired by performing the following control by the satellite search control section 37. First, provide the elevation angle and the azimuth angle for starting the search to the elevation angle/azimuth angle calculation section 17. Control the rotation angle calculation section for each axis 19, to rotate the antenna gradually. Then, store the reception state in respective directions together with the direction of the antenna in the satellite position data memory 33, via the detection section 29 and the reception level measuring section 31. Moreover, change the elevation angle and the azimuth angle, and perform measurement while rotating the antenna. By performing the similar operation, the search is performed.

Figure 18:
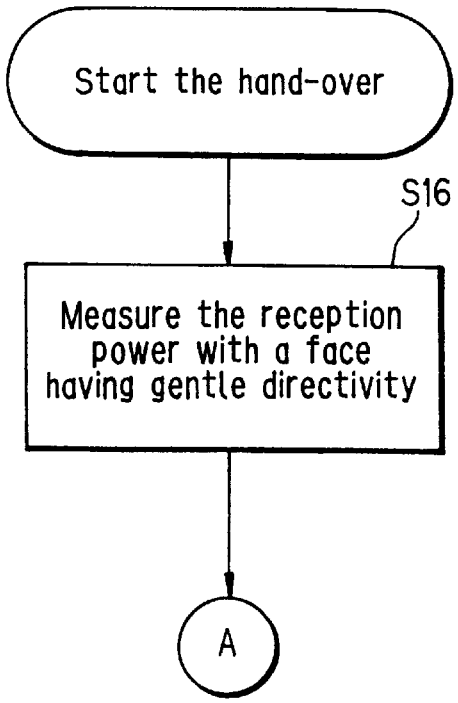
FIG. 18 is a flowchart of a second method in the case where the satellite orbit cannot be foreseen, at the time of the hand-over operation in the seventh embodiment.

A second method is, as shown in FIG. 18, to make the one side of the antenna (e.g., in FIG. 14, the second antenna 1*e*R) as an antenna face having a gentle directivity, making it easy to receive the signal.

At the time of hand-over, that face is used to measure the reception power (S16 in FIG. 18), to thereby approximate the position of the satellite (hour, minute and the like).

Then. direct the other face (e.g. in FIG. 14, the first antenna 1*e*) to the approximated position (to turnover), and the positioning of the antenna is performed. The processing hereafter proceeds to S11 in FIG. 15.

In the case of the second method, the satellite S2 is acquired in the similar manner as the first method by the satellite search control section 37.

To find the satellite B whose position is unknown in this manner is very effective, for example, when the weather condition in the sky is bad, and the reception power can be gained by following another satellite rather than following the current satellite (from the direction of the antenna, the reception power which could be obtained at that time can be seen, therefore, when the reception value is greatly lower than the known value), and when the antenna has lost sight of the satellite from some reason.

[Eighth Embodiment]

Figure 19:
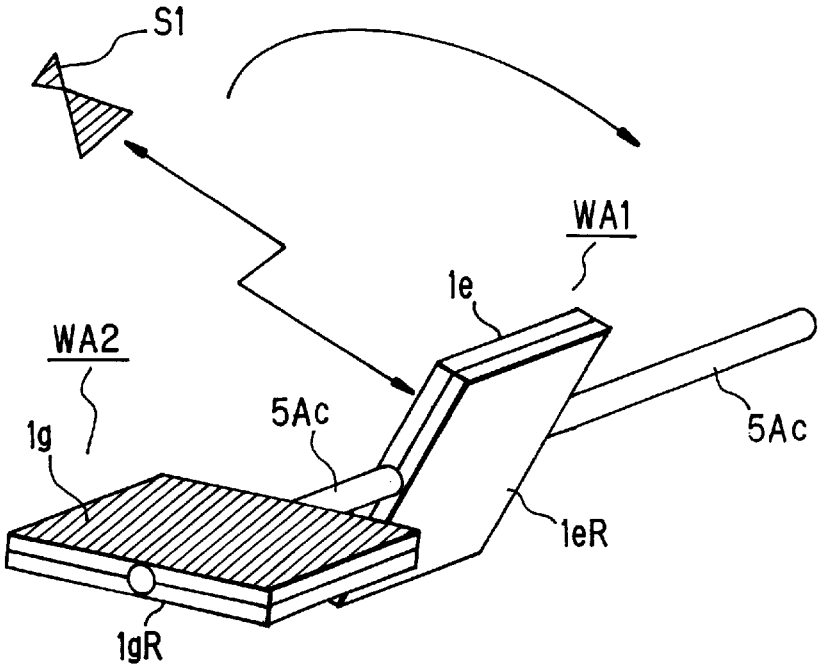
FIG. 19 is a perspective view showing the antenna face attached to the tip of the antenna mounting arm according to the eighth embodiment of the present invention.

FIG. 19 shows the eighth embodiment of the present invention. Similar to the seventh embodiment, only the antenna face is shown, and it has a construction that the first and second antennas are attached back to back (antenna group), and additionally, these planar antenna groups are connected in parallel in plural numbers (here, two in one side).

In the initial state of the antenna set up, it is assumed that a first antenna le in a first antenna group WA1 communicates with a target satellite (satellite S1) (third and fourth antennas 1*g*, 1*g*R in a second antenna group WA2 are in a standby state).

Figure 20:
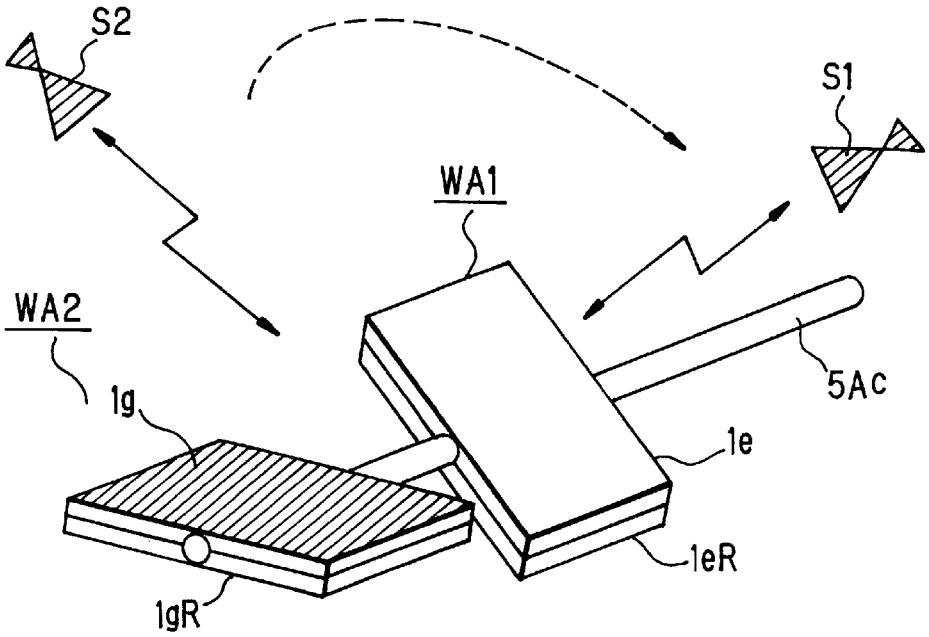
FIG. 20 is a diagram showing a case where in the eighth embodiment, a new satellite S2 appeared, and the communication target is changed from the satellite S1 to the satellite S2.

Then, with the lapse of time, as shown in FIG. 20, a new satellite S2 appears, and the communication target is changed over from the satellite S1 to the satellite S2. In this case, when the orbit of the satellite can be acquired, either of the third or fourth antenna 1*g*, 1*g*R (either one which can move in the shortest route) is moved to the position where the satellite S2 will come, and when the satellite S2 is acquired, either one of the first and second antennas 1*e*, 1*e*R (either one which can move in the shortest route) is directed similarly to the satellite S2. As described above, reception/transmission of the signal can be performed with four antennas in total.

Alternatively, when the third and fourth antennas 1*g*, 1*g*R are in communication with the satellite S2, the first and second antennas 1*e*, 1*e*R may be the one for searching the next satellite subsequent to the satellite S2.

When the orbit of the satellite cannot be acquired, by rotating the third and fourth antennas 1*g*, 1*g*R, the approximate position of the satellite can be acquired.

Moreover, the third and fourth antennas 1*g*, 1*g*R may be used as an antenna (exclusive for signal reception) for recognizing the position of the satellite by designating either one face of the third and fourth antennas 1*g*, 1*g*R as the antenna face having a gentle directivity, and the other face as the antenna face having a normal directivity. In such a method, the direction of the antenna to the satellite S2 is decided by the second antenna group WA2, and the antenna face of the shortest route is determined and operated from this position and the positional direction of the current antenna face of the first antenna group WA1 (completion of the hand-over).

[Ninth Embodiment]

Figure 21:
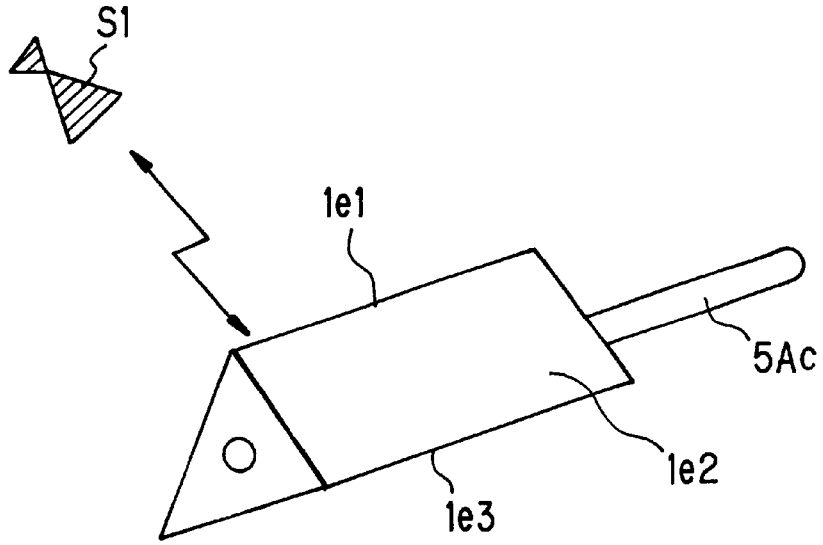
FIG. 21 is a perspective view showing an antenna portion of a ninth embodiment of the antenna system according to the present invention.

FIG. 21 shows the ninth embodiment of the present invention. Similar to the seventh embodiment, only the antenna face is shown, and the antenna face which is the communication target is provided with a first to a third antennas 1*e*1, 1*e*2 and 1*e*3 on the sides of a triangular pillar which is a polygonal body as shown in the drawing.

In the initial state of the antenna set up, when the first antenna 1*e*1 communicates with the target satellite (satellite S1), the first antenna 1*e*1 follows the satellite S1.

Figure 22:
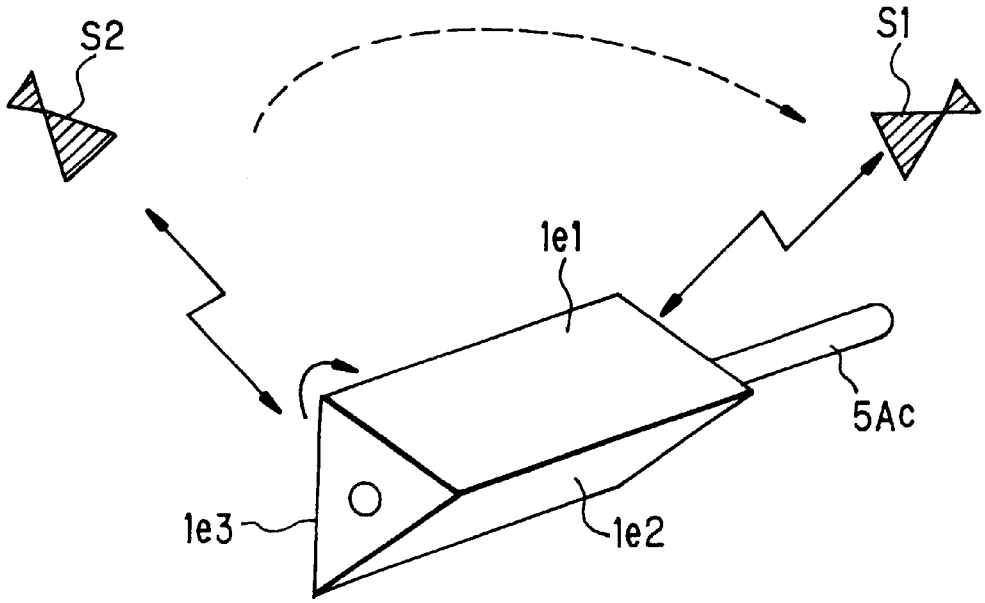
FIG. 22 is a diagram showing a case where in the ninth embodiment, a new satellite S2 appeared, and the communication target is changed from the satellite S1 to the satellite S2.

Then, with the lapse of time, as shown in FIG. 22, a new satellite S2 appears, and the communication target is changed over from the satellite S1 to the satellite S2.

When the orbit of the satellite S2 cannot be acquired, by rotating the first to third antennas 1*e*1, 1*e*2 and 1*e*3, the reception power is measured, the approximate position of the satellite S2 is narrowed from the power distribution, the antenna is further moved, to thereby find the position where the reception power becomes a prescribed value, that is, the satellite S2 can be acquired.

When the orbit of the satellite can be acquired, the second and third antennas 1*e*2 and 1*e*3 are made in the reception only mode (the transmission circuit is in a sleep state), the reception power is measured, and it is assumed that the approximate position of the next satellite is always acquired from the power distribution.

In this case, the nearest antenna face to the vicinity of the position of the satellite S2 by the reception power distribution (the antenna face which can take the shortest route) is directed to the satellite S2.

[Tenth Embodiment]

Figure 23:
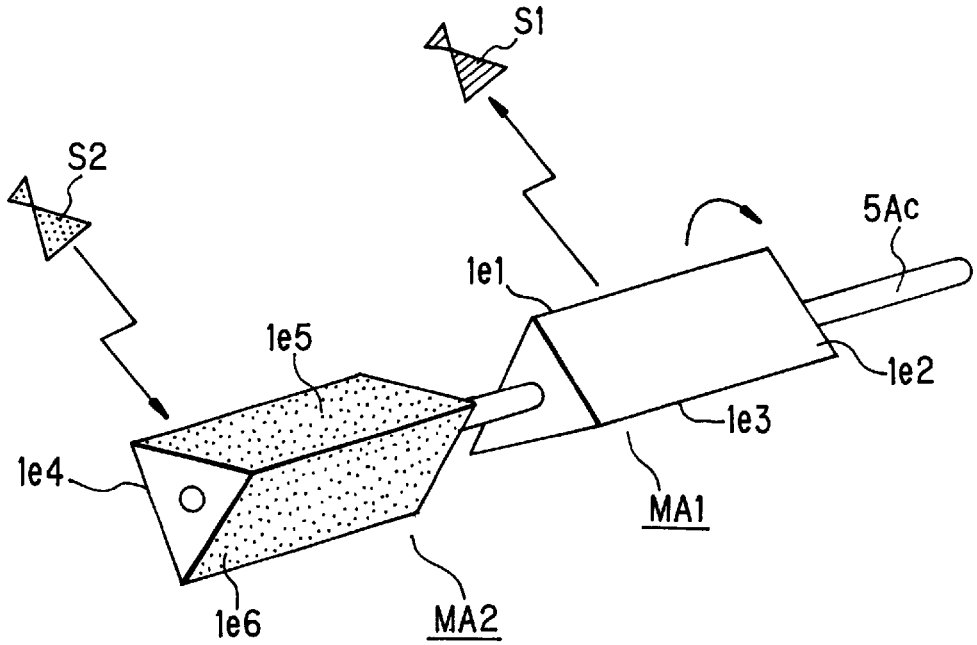
FIG. 23 is a perspective view showing an antenna portion of a tenth embodiment of the antenna system according to the present invention.
Figure 24:
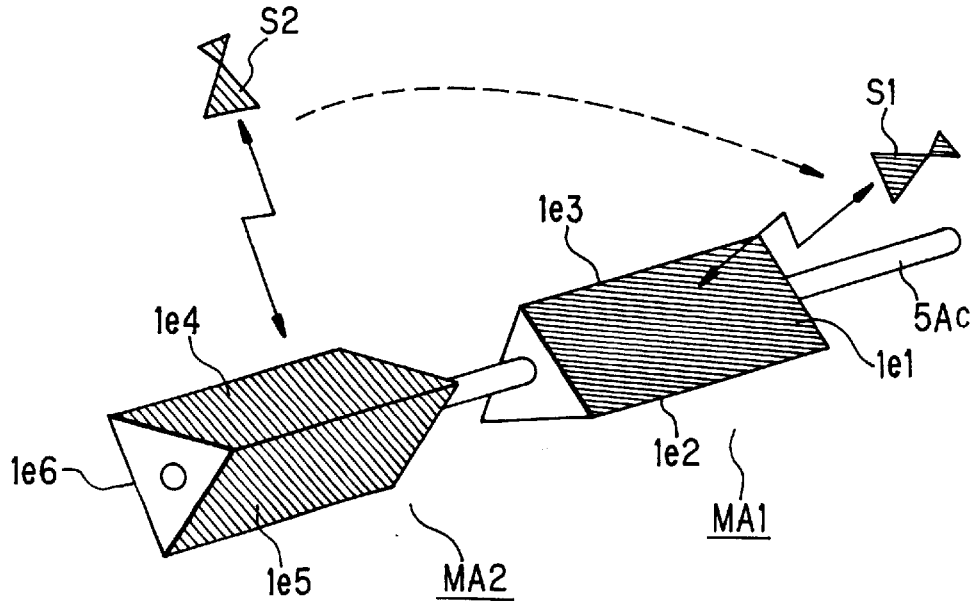
FIG. 24 is a diagram of an antenna which has first to third and fourth to sixth separate planes of polarization which are sides of a triangular support antenna of the tenth embodiment of the present invention, and which can communicate with satellites which are respectively separate communication systems.

FIG. 23 and FIG. 24 show the tenth embodiment, wherein two antenna groups are provided in parallel, in which antennas are disposed on the sides of a triangular pillar.

Similar to the above embodiment, only the antenna face is shown, and a case where the satellite S1 and the satellite S2 having different communication systems will be described.

In FIG. 23, the first to the third antennas 1*e*1, 1*e*2 and 1*e*3 which are the sides of the triangular pillar of a first antenna group MA1 have an antenna transmission/reception section for performing communication with the satellite S1, and the fourth to the sixth antennas 1*e*4, 1*e*5 and 1*e*6 which are the side of the triangular pillar of a second antenna group MA2 have an antenna transmission/reception section for performing communication with the satellite S2, and they can perform communication with respectively different communication systems.

If signals are transmitted from (one of) the first to the third antennas 1*e*1, 1*e*2 and 1*e*3 or (one of) the fourth to the sixth antennas 1*e*4, 1*e*5 and 1*e*6 simultaneously, it can be envisioned that interference or the like may be caused. Therefore, for example, when the first to the third antenna faces are transmitting, the fourth to the sixth antenna faces become antennas exclusive for reception. Thereby, highly reliable communication becomes possible.

In FIG. 24, the first to the third antenna faces and the fourth to the sixth antenna faces which are sides of the triangular pillar are antennas having respectively different planes of polarization, and communication with satellites which are respectively separate communication systems becomes possible.

[Eleventh Embodiment]

The eleventh embodiment of the present invention will now be described in detail with reference to FIG. 25 to FIG. 32. FIG. 25 to FIG. 29 show a first example of the antenna system according to this embodiment. Incidentally, the same reference numerals are given to the same parts as those of the above embodiments.

Figure 25:
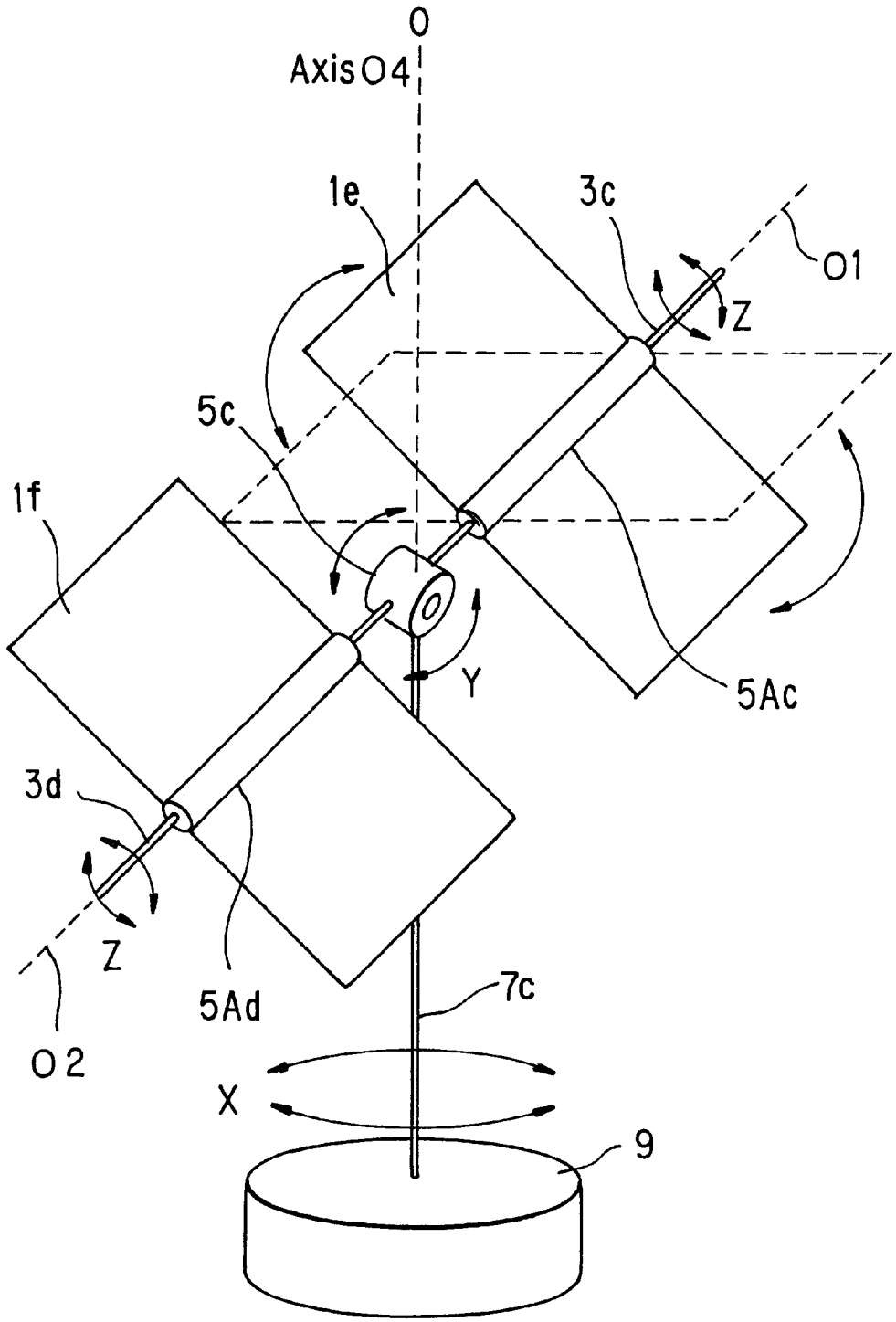
FIG. 25 is a perspective view showing a schematic diagram of a first example of a eleventh embodiment of the antenna system according to the present invention.

As shown in FIG. 25, the antenna control system of the eleventh embodiment comprises: a first bracket 3*c* for supporting an antenna; a second bracket 3*d* for supporting an antenna; a first antenna 1*e* mounted to the first bracket 3*c* with the directivity thereof being in an optional direction with respect to the axis O1 of the first bracket; a second antenna 1*f* mounted to the second bracket 3*d* with the directivity thereof being in an optional direction with respect to the axis O2 of the second bracket; a first rotation mechanism 5A*c* for rotating the first antenna 1*e* around the axis O1; a second rotation mechanism 5A*d* for rotating the second antenna 1*f* around the axis O2; an elevation angle adjusting mechanism 5*c* common to the first and second brackets 3*c* and 3*d*; and a turntable 9 which is an azimuth angle adjusting mechanism common to the first and second brackets 3*c* and 3*d*, wherein the first bracket 3*c* and the second bracket 3*d* are arranged in a parallel and non-facing state on the same plane, the first antenna le being for communication and the second antenna 1*f* being a pilot antenna.

That is to say, the antenna system shown in FIG. 25 has the turntable 9 freely rotatably and adjustably in the horizontal direction X, the elevation angle adjusting mechanism 5*c* freely rotatably and adjustably in the elevation angle direction Y, which is supported on the rotation axis O4 of the azimuth angle adjusting mechanism of the turntable 9 via a support 7*c*, and the first and second brackets 3*c* and 3*d* extending to the left and right direction from the both ends of the elevation angle adjusting mechanism 5*c*. The first and second brackets 3*c* and 3*d* share the elevation angle adjusting mechanism 5*c* and are arranged in a parallel and non-facing state on the same plane.

The first bracket 3*c* is provided with the first antenna 1*e*, and the first antenna 1*e* is supported freely rotatably and adjustably so that it has the directivity in an optional rotation direction Z around the axis O1 of the first bracket 3*c* independently via the first rotation mechanism 5A*c*.

The second bracket 3*d* is provided with the second antenna 1*f*, and the second antenna if is supported freely rotatably and adjustably so that it has the directivity in an optional rotation direction Z around the axis O2 of the second bracket 3*d* independently via the second rotation mechanism 5A*d*.

Then, the first antenna 1*e* is used as a communication antenna (hereinafter referred to as a "communication antenna"), and the second antenna 1*f* is used as a pilot antenna (hereinafter referred to as a "pilot antenna"). The pilot antenna 1*f* has a wide directivity for making it easy to acquire the satellite, and has properties different from those of the communication antenna le as the communication antenna, so that it can receive only the pilot signal from the satellite in a range as wide as possible, regardless of the direction of the antenna.

The communication antenna le performs communication with the target satellite. On the other hand, the pilot antenna If controls the rotation angle calculation section 19 for each axis by means of the satellite search control section 37 and performs reception of the pilot signal from the other new satellite, while always rotating the antenna little by little (see FIG. 16).

As described above, by always rotating the pilot antenna if, the direction of the antenna face always changes, and the intensity of the pilot signal received according to the change in the direction of the antenna face changes. Therefore, by making the rotation speed of the antenna sufficiently faster than the moving speed of the satellite, the intensity of the reception signal changes corresponding to the change in the direction of the antenna face by means of the rotation of the antenna.

That is to say, when the pilot antenna if receives the pilot signal from the satellite, the intensity of the reception signal is measured, and at that time, by representing the direction where the pilot antenna If is facing as the azimuth angle X by means of the turntable 9, the elevation angle Y by means of the elevation angle adjusting mechanism 5*c* and the rotation angle Z by means of the second rotation mechanism 5A*d* around the axis O2, the data representing the relation between the direction where the pilot antenna if is facing and the intensity of the reception signal at that time can be obtained. In addition, the reception state in each direction is stored in the satellite position data memory 33, together with the direction of the antenna.

Based on the data of several reception states stored in the satellite position data memory 33, the position of the satellite at this point of time is estimated by the satellite position estimation section 35. From the satellite position information, the azimuth angle X and the elevation angle Y of the satellite is calculated by the elevation angle/azimuth angle calculation section 17, and motors for each axis are driven through the rotation angle calculation section 19 for each axis, the pulse generation section 21 and the antenna driving section 23, and then the communication antenna le is directed to the direction of the satellite acquired by the pilot antenna If.

FIG. 26 to FIG. 29 show the control state of the antenna apparatus with respect to the two non-geostationary satellites S1 and S2 which go around the orbit of the celestial sphere.

Figure 26:
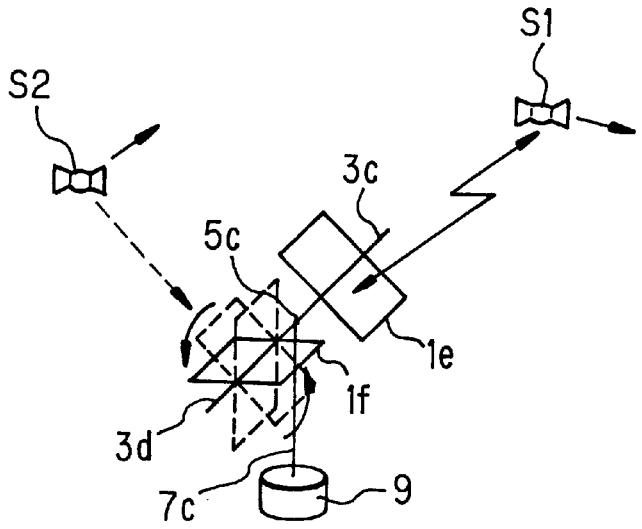
FIG. 26 is a diagram showing the communication with a target satellite and the state of acquiring/following another satellite by means of the antenna system according to the first example of the eleventh embodiment, and showing the communication state of the communication antenna with the target satellite and the state of acquiring/following a new satellite by means of the pilot antenna.

As shown in FIG. 26, the communication antenna 1*e* is in a state capable of communicating with the target satellite S1, and on the other hand, the pilot antenna If receives the pilot signal from the other new satellite S2 and acquires and follows the position of the satellite S2.

Figure 27:
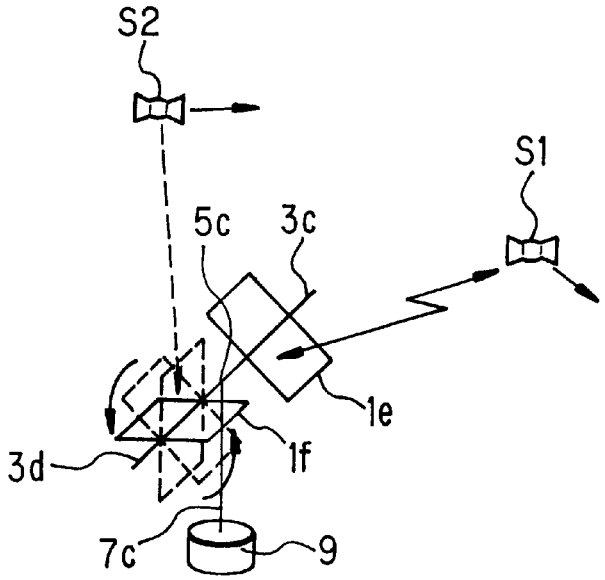
FIG. 27 is a diagram showing the communication with a target satellite and the state of acquiring/following another satellite by means of the antenna system according to the first example of the eleventh embodiment, and showing the state immediately before changing over from the communication state of the communication antenna with the target satellite to the state that the communication is changed over to another new satellite by means of acquisition and follow up of the pilot antenna.
Figure 28:
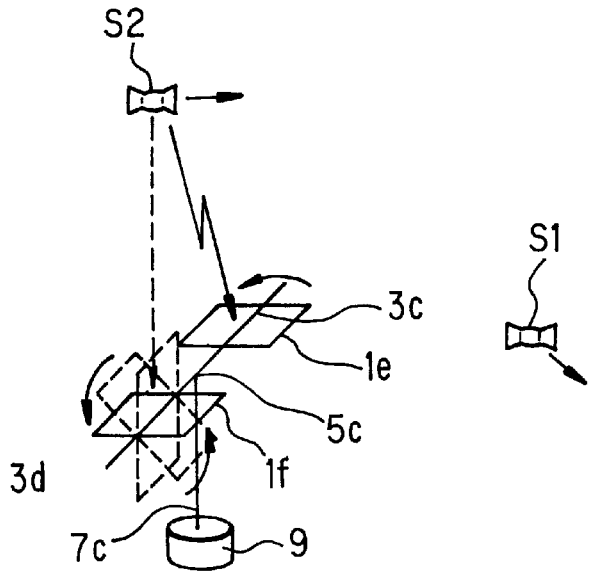
FIG. 28 shows the communication hand-over state from the target satellite to another new satellite by means of the antenna system according to the first example of the eleventh embodiment, and is a diagram immediately after the communication hand-over.

In the above state, as shown in FIG. 27, when the communication antenna 1*e* has to change over the communication from the satellite S1 to the satellite S2, it is necessary to change over the direction of the antenna face of the communication antenna le from the satellite S1 to the satellite S2.

At this time, the azimuth angle X, the elevation angle Y and the rotation angle Z of the communication antenna 1*e* with respect to the satellite S2 are adjusted based on the position estimation data of the second satellite S2, measured by the pilot antenna if as described above, thereby as shown in FIG. 28, the communication hand-over from the satellite S1 to the satellite S2 is performed.

Figure 29:
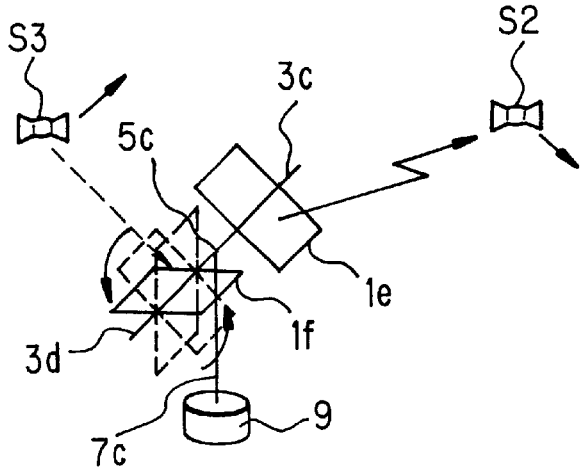
FIG. 29 is a diagram showing the state of acquiring/following a new satellite by means of the pilot antenna, after the communication hand-over shown in FIG. 28.

On the other hand, the pilot antenna If after the communication hand-over from the satellite S1 to the satellite S2 with respect to the communication antenna le continues to rotate for receiving the pilot signal from the other new non-geostationary satellite S3 and acquires the satellite S3, as shown in FIG. 29.

Figure 30:
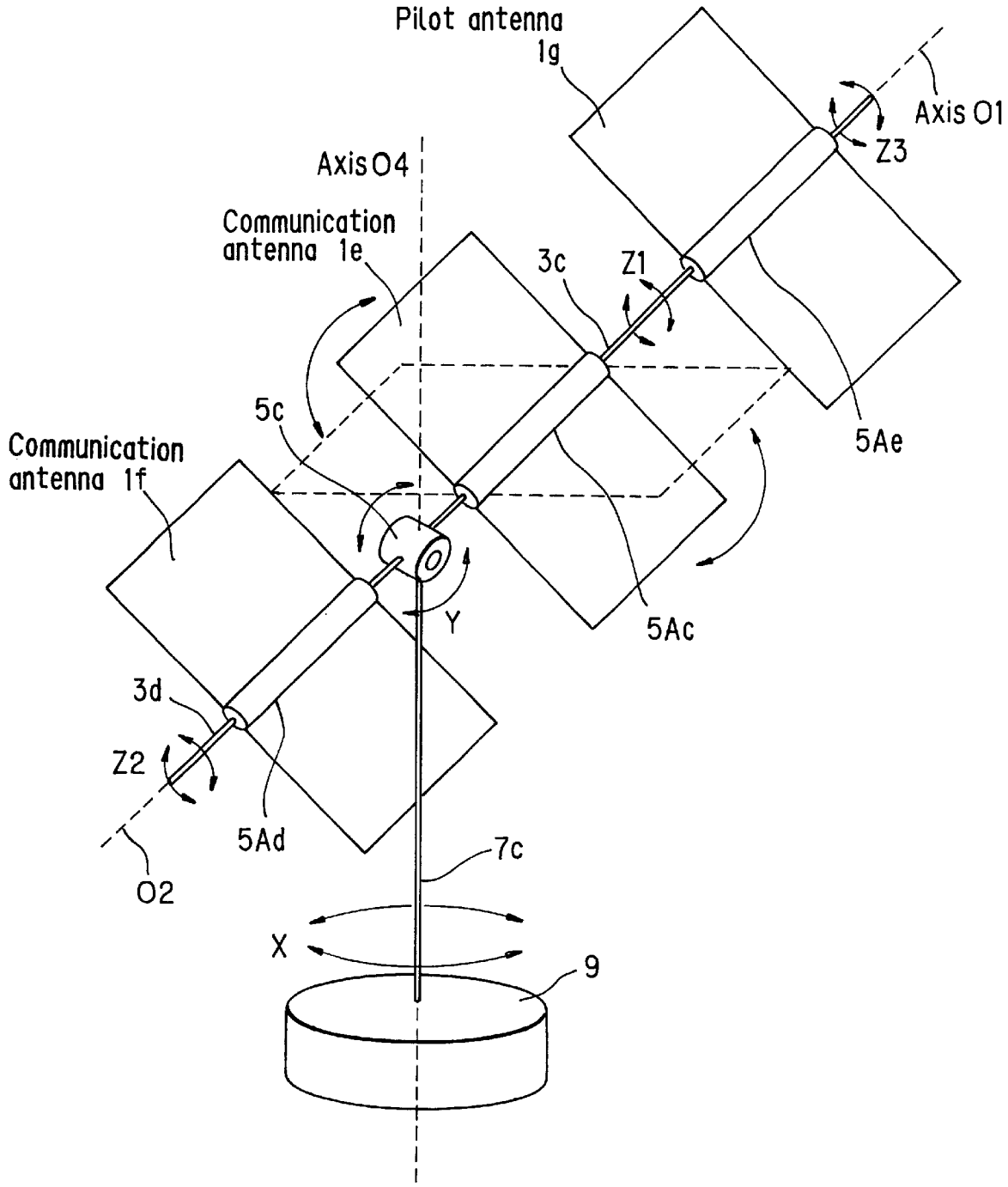
FIG. 30 is a perspective view showing a schematic diagram of a second example of the eleventh embodiment of the antenna system according to the present invention.

FIG. 30 shows a second example of the antenna system according to this embodiment. The antenna system in this second example has such a construction added to the first example described above that a third antenna ig is rotatably and adjustably supported via a third rotation mechanism 5A*e*, so that the third antenna has the directivity in an optional rotation direction Z1 together with the first antenna 1*e*, centering on the axis O1 of the first bracket 3*c*.

In this case, the first and the second antennas 1*e* and if are used as the communication antenna, and the third antenna 1*g* is used as the pilot antenna, hence the third antenna 1*g* is independently rotatable and adjustable so as not to become an obstacle to the communication with respect to the first antenna 1*e*.

That is to say, with the second example shown in FIG. 30, similarly to the first example described above, the first antenna 1*e* performs communication with the target satellite S1, while the pilot antenna 1*g* acquires a new satellite S2. Hence, at the time of communication hand-over from the satellite S1 to the satellite S2, the azimuth angle X, the elevation angle Y and the rotation angle Z of the second communication antenna 1*f* with respect to the satellite S2 are adjusted based on the measurement data of the satellite S2 measured by the pilot antenna 1*g*, hence the hand-over to the satellite S2 is performed.

At this time, the first communication antenna 1*e* is so set as to continue the communication until the target satellite S1 is changed over to the satellite S2. After the communication hand-over to the second communication antenna 1*f*, the antenna face of the communication antenna 1*e* is adjusted to the same direction of the second communication antenna 1*f* to thereby enable the communication of the communication antenna 1*e* together with the second communication antenna 1*f* with the new satellite S2. The pilot antenna 1*g* continues to rotate to thereby acquire the next new satellite S3.

Figure 31:
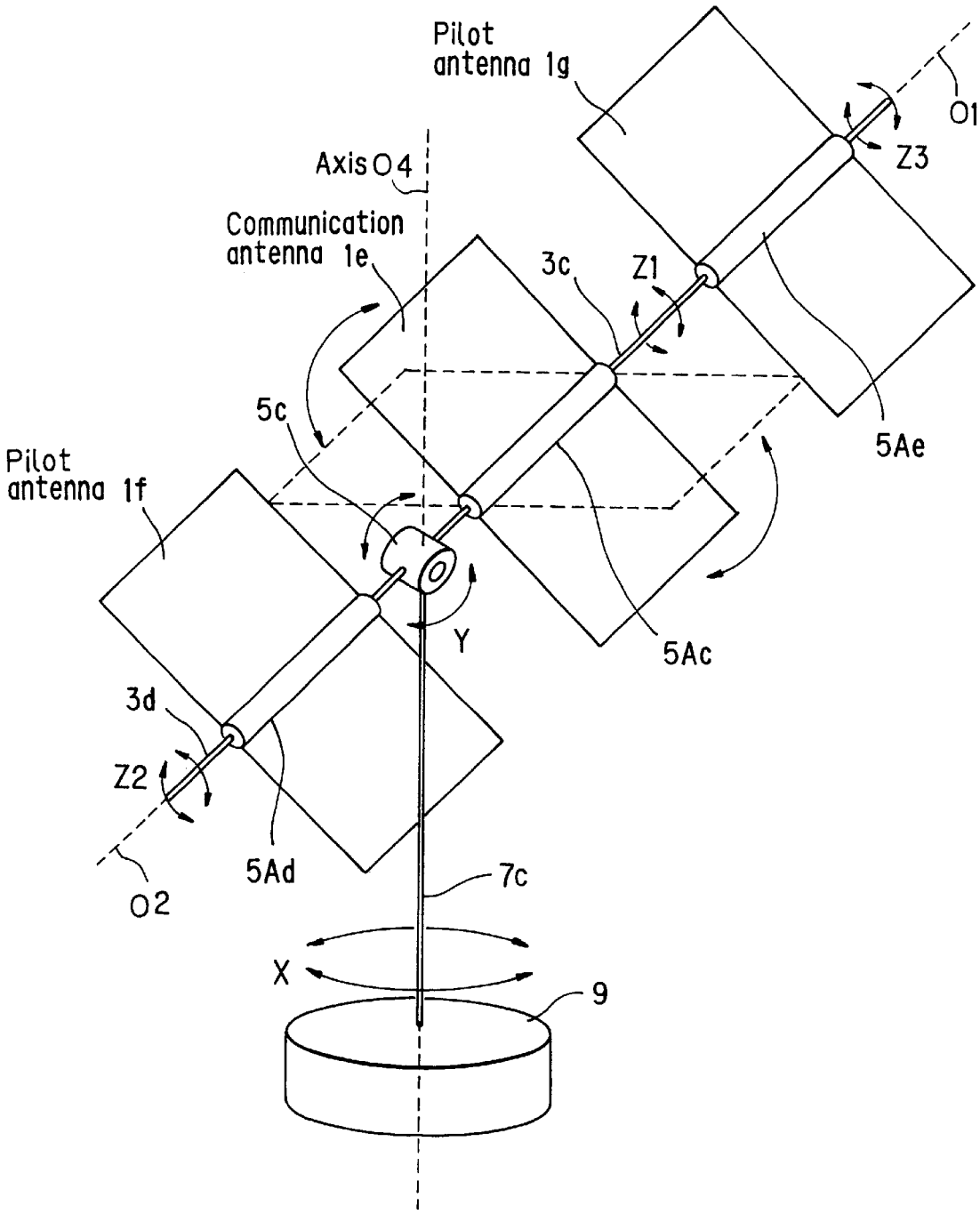
FIG. 31 is a perspective view showing a schematic diagram of a third and fourth examples of the eleventh embodiment of the antenna system according to the present invention.

FIG. 31 shows a third example of the antenna system according to the eleventh embodiment, wherein the first antenna 1*e* is used as the communication antenna, and the second and the third antennas 1*f*, 1*g* are used as the pilot antenna.

That is to say, with the third example shown in FIG. 31, similar to the second example described above, the first communication antenna 1*e* performs communication with the target satellite S1, while the two pilot antennas 1*f*, 1*g* rotate in the same direction and at the same speed to acquire 4*a* new satellite S2, and receive pilot signals from the satellite S2 independently. By using the two pilot antennas 1*f* and 1*g*, the measurement error in the measurement value of the intensity of the reception signal can be reduced. Thereby, the estimation error can be reduced compared to the case where the acquisition and measurement of the satellite are performed by only one pilot antenna as in the above described first or second example.

As a fourth example of the eleventh embodiment, there is a case where the rotation direction of the two pilot antennas 1*f* and 1*g* is reversed to each other, or the rotation direction is made the same, but the rotation speed is changed, though the appearance is the same as the third example shown in FIG. 31. Thereby, the measurement data of the reception pilot signal with respect to the different directions of the antenna can be obtained. Therefore, errors in the direction estimation value of the satellite can be reduced with a method of changing the estimation algorithm or the like.

The rotation angle of each pilot antenna 1*f*, 1*g* is restricted to the range of, for example, from 0° to 180°, and it is controlled such that at the time that each pilot antenna 1*f*, 1*g* rotates to 180°, it is reversed to rotate 180. Moreover, the pilot antennas 1*f* and 1*g* are set up so that their antenna faces are directed to the opposite direction, and their rotation is controlled so that their antenna faces are directed to 3600, while these antenna faces back up each other. With the above construction, it becomes possible to prevent entanglement of the wiring with each pilot antenna 1*f*, 1*g* and their rotation driving axes 5A*c*, 5A*d* and 5A*e* and the like, thereby it becomes possible to reliably prevent poor operation of the antenna.

Figure 32:
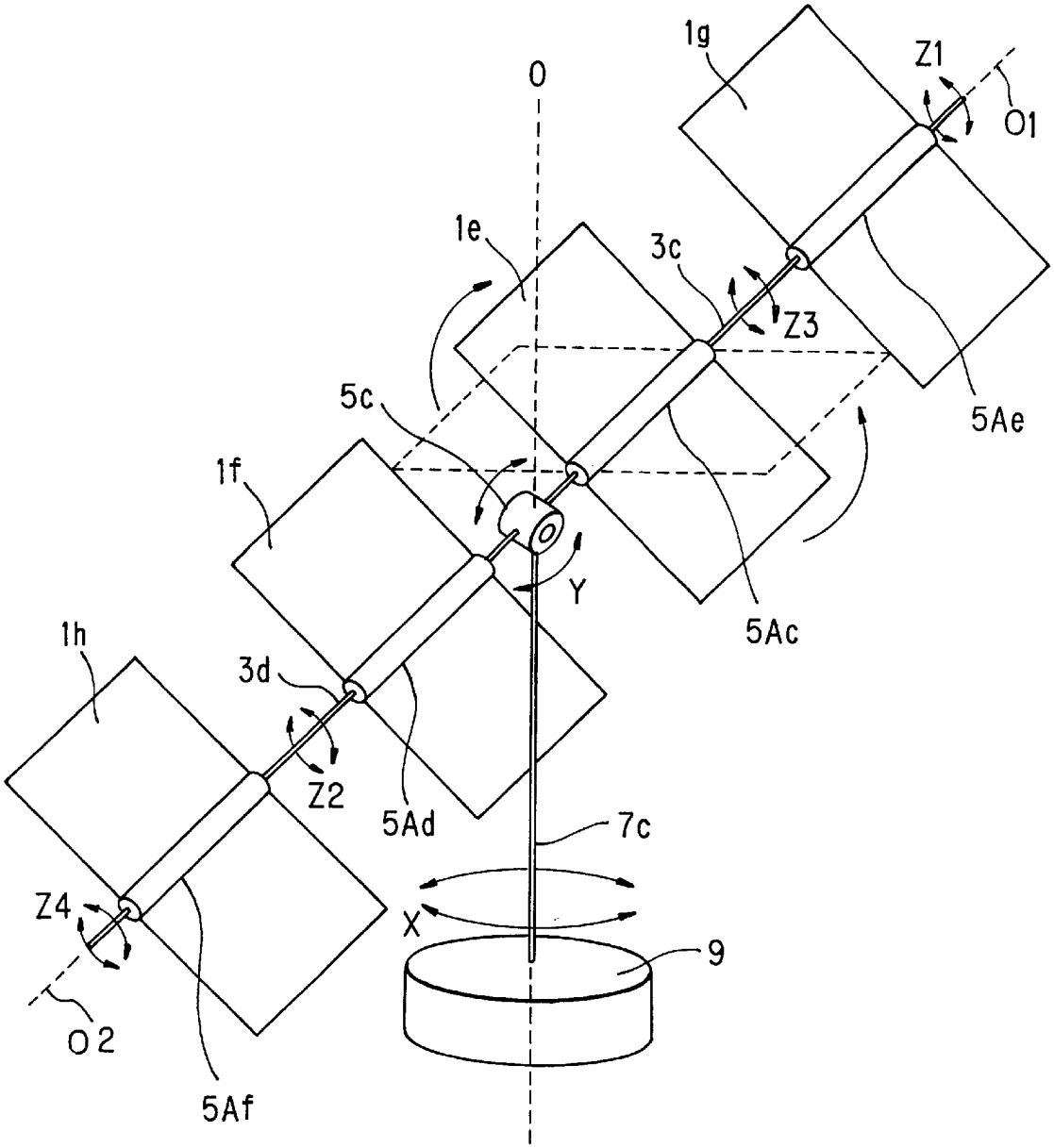
FIG. 32 is a perspective view showing a schematic diagram of a fifth example of the eleventh embodiment of the antenna system according to the present invention.

FIG. 32 shows a fifth example of the antenna system according to the eleventh embodiment. It has a construction that in the above described third and fourth examples, a fourth antenna lh is rotatably and adjustably supported via a fourth rotation mechanism 5A*f* so as to have the directivity in an optional rotation direction Z together with the second antenna 1*f*, centering on the axis O2 of the second bracket 3*d* for supporting the second antenna.

In this case, the first and second antennas 1*e* and 1*f* are used respectively as the communication antenna, and the third and fourth antennas 1g and 1h are used respectively as the pilot antenna. These respective antennas 1*e*, 1*f*, 1*g* and 1*h* are respectively independently rotatable and controllable.

According to the fifth example, by combining the structures of the second to the fourth examples described above, all the operation of the above described second to the fourth examples can be obtained.

As is obvious from the description of the eleventh embodiment, the antennas are rotatably and adjustably supported on the first bracket for supporting the antenna and on the second bracket for supporting the antenna, respectively, via the rotation mechanism, so as to have the directivity in an optional rotation direction Z, centering on the respective axis of branket, and each antenna is used as the communication antenna and the pilot antenna. In addition, since the first bracket for supporting the antenna and the second bracket for supporting the antenna have a common elevation angle adjusting mechanism supported on the azimuth angle adjusting mechanism, each antenna is driven by the antenna rotation mechanism, the azimuth angle adjusting mechanism and the elevation angle adjusting mechanism of each antenna. Thereby, the antennas can be directed simultaneously to satellites being the communication targets existing in the different two directions from the reception point. Furthermore, since the respective antennas do not become an obstacle to each other's communication, the communication antenna can be easily and rapidly directed to the same direction as the pilot antenna which has acquired the target satellite. Hence, the directional control of the antenna can be easily performed.

It is a matter of course that the present invention is not limited to the above described embodiments and examples, and can be variously modified without departing the gist of the present invention.

What is claimed is:

1. An antenna system comprising:

a first rotation mechanism supporting a first antenna rotatably in a first rotation direction centering around a first axis;

a second rotation mechanism supporting a second antenna rotatably in the first rotation direction centering around a second axis running along or in parallel to said first axis;

an elevation angle adjusting mechanism for rotatably supporting said first and second rotation mechanisms commonly in a second rotation direction, centering around a third axis different from said first axis and said second axis; and an azimuth angle adjusting mechanism for rotatably supporting said elevation angle adjusting mechanism in a third rotation direction, centering around a fourth axis different from said first axis and said third axis;

wherein said first rotation mechanism is provided in a first area partitioned by a plane containing said third axis and running in parallel to said fourth axis, and said second rotation mechanism is provided in a second area opposite to said first area.

2. The antenna system according to claim 1, wherein said first and second axes are provided symmetrically to a plane containing said fourth axis and running in parallel to said third axis.

3. The antenna system according to claim 1, wherein said third and fourth axes intersect each other, and said first and second axes are provided point-symmetrically with respect to an intersection of said third axis and said fourth axis.

4. The antenna system according to claim 1, wherein said third and fourth axes are orthogonal to each other, and said first and second axes are orthogonal to a plane determined by said third and fourth axes.

5. The antenna system according to claim 1, wherein said first and second axes penetrate the center of gravity of the respective antenna.

6. The antenna system according to claim 1, wherein said first antenna is constituted of a planar antenna, and said first axis penetrate said planar antenna bilaterally symmetrically.

7. The antenna system according to claim 1, wherein a third rotation mechanism is provided for supporting rotatably one or more antennae in said first rotation direction centering on said first axis.

8. The antenna system according to claim 1, wherein said first antenna comprises a spherical radio lens and a primary radiator for transmitting and receiving the radio wave, wherein said primary radiator rotates with the rotation of the first rotation mechanism along the peripheral direction around the periphery of the radio lens, to thereby realize the rotation of the antenna.

9. The antenna system according to claim 1, wherein a third antenna is provided which shares the first rotation mechanism with said first antenna, and points to a direction different from that of the first antenna.

10. The antenna system according to claim 9, wherein said first antenna and said third antenna are a planar antenna, respectively, and said first antenna and said third antenna are integrated back to back, and the both f aces are used as the antenna.

11. The antenna system according to claim 1, wherein said first antenna is a polyhedral antenna in a form of a square column, whose sides of N (natural number of N≧3) are planar antennas.

12. The antenna system according to claim 10, wherein the properties of said first antenna and the properties of said third antenna are different.

13. The antenna system according to claim 11, wherein the N planar antennas comprise more than two kinds of planar antennas having different properties.

14. The antenna system according to claim 1, wherein said first antenna is for communication, and said second antenna is a pilot antenna.

15. The antenna system according to claim 7, wherein among three antennas, two of them are antennas for communicating with a satellite and the remaining one is a pilot antenna.

16. The antenna system according to claim 7, wherein among three antennas, two of them are pilot antennas and the remaining one is an antenna for communicating with a satellite.

17. The antenna system according to claim 16, wherein the method of rotating said two pilot antennas is changed for each antenna.

* * * * *